US012616273B2

(12) United States Patent
Thatcher

(10) Patent No.: US 12,616,273 B2
(45) Date of Patent: May 5, 2026

(54) SHOE WITH IMPROVED STABILITY

(71) Applicant: Sazzi IP, LLC, Sedona, AZ (US)

(72) Inventor: Mark Aaron Thatcher, Sedona, AZ (US)

(73) Assignee: Sazzi IP, LLC, Sedona, AZ (US)

( * ) Notice: Subject to any disclaimer, the term of this patent is extended or adjusted under 35 U.S.C. 154(b) by 3 days.

(21) Appl. No.: 18/004,163

(22) PCT Filed: Jul. 12, 2021

(86) PCT No.: PCT/US2021/070861
§ 371 (c)(1),
(2) Date: Jan. 3, 2023

(87) PCT Pub. No.: WO2022/016180
PCT Pub. Date: Jan. 20, 2022

(65) Prior Publication Data

US 2023/0337782 A1 Oct. 26, 2023

Related U.S. Application Data

(60) Provisional application No. 63/053,373, filed on Jul. 17, 2020.

(51) Int. Cl.
*A43B 7/26* (2006.01)
*A43B 7/20* (2006.01)

(52) U.S. Cl.
CPC . *A43B 7/26* (2013.01); *A43B 7/20* (2013.01)

(58) Field of Classification Search
CPC ..... A43B 7/20; A43B 7/26; A43B 23/0265; A43B 23/08; A43B 23/088; A43B 23/14;
(Continued)

(56) References Cited

U.S. PATENT DOCUMENTS 963,605 A 7/1910 Mannesmann
1,349,095 A 8/1920 Sebastiano
(Continued)

FOREIGN PATENT DOCUMENTS

CN 204561121 U 8/2015
CN 205267135 U 6/2016
(Continued)

OTHER PUBLICATIONS

PCT International Search Report and Written Opinion, mailed Oct. 7, 2021, regarding International Application No. PCT/US21/706861, 28 pages.

*Primary Examiner* — F Griffin Hall
(74) *Attorney, Agent, or Firm* — Knobbe, Martens, Olson & Bear LLP

(57) ABSTRACT

A shoe with an interstitial (e.g., between the toes) support for the user's foot that provides improved stability to the user's foot. The internal toe-reliant support includes two to four posts that extend into the gaps between toes in the foot and are positioned proximate the vertices or posterior ends of the gaps. The posts inhibit or limit motion of the foot within the shoe, such as when initiating or terminating a motion in a medial, lateral or forward direction (e.g., while walking, hiking or running on level ground or downhill), or when initiating or terminating a clockwise or counterclockwise pivoting motion about the toe portion of the shoe.

9 Claims, 18 Drawing Sheets

(58) Field of Classification Search
CPC ..... A43B 23/16; A43B 23/17; A43C 11/004; A43C 11/14; A43C 11/1493
USPC ..... 36/94
See application file for complete search history.

(56) References Cited

U.S. PATENT DOCUMENTS

| | | | | | |
|---|---|---|---|---|---|
| 1,402,375 | A | | 1/1922 | Parisi | |
| 1,867,679 | A | * | 7/1932 | Riehle | A43B 7/26 36/94 |
| 2,506,308 | A | * | 5/1950 | Maynier | A45D 29/22 132/73 |
| 2,740,207 | A | * | 4/1956 | Starensier | A43B 7/26 36/94 |
| 3,299,894 | A | * | 1/1967 | Charlebois | A61F 13/068 602/30 |
| 3,967,390 | A | * | 7/1976 | Anfruns | A41B 11/004 36/94 |
| 4,103,437 | A | | 8/1978 | Dillard | |
| 4,207,880 | A | | 6/1980 | Zinkovich | |
| 4,547,981 | A | * | 10/1985 | Thais | A43C 11/1493 36/114 |
| 4,972,613 | A | * | 11/1990 | Loveder | A43B 11/00 36/105 |
| 5,408,761 | A | * | 4/1995 | Gazzano | A43B 13/12 36/31 |
| 5,701,689 | A | * | 12/1997 | Hansen | A43B 7/20 36/88 |
| 5,813,078 | A | * | 9/1998 | Hogan, Sr. | A47K 7/026 4/606 |
| 6,082,027 | A | | 7/2000 | Wagonhurst | |
| 6,151,801 | A | * | 11/2000 | Frederiksen | A43B 3/105 36/94 |
| 7,134,225 | B2 | * | 11/2006 | Ashton | A43B 11/00 36/94 |
| 7,676,850 | B2 | | 3/2010 | Steel | |
| 7,685,746 | B2 | * | 3/2010 | Kipnes | A43B 3/24 36/105 |
| 8,196,321 | B2 | | 6/2012 | Baker et al. | |
| 8,832,971 | B2 | | 9/2014 | Heid | |
| 8,959,796 | B2 | * | 2/2015 | Lazaris | A43B 3/102 36/97 |
| 9,314,068 | B2 | | 4/2016 | Schmutte | |
| 9,668,534 | B2 | * | 6/2017 | Normand | A43B 5/02 |
| 10,136,684 | B2 | | 11/2018 | Meiselman | |
| 10,265,209 | B2 | | 4/2019 | Ferri | |
| 10,973,277 | B2 | | 4/2021 | Chenciner | |
| 2004/0055179 | A1 | * | 3/2004 | Wang | A43B 3/103 36/8.1 |
| 2005/0229430 | A1 | * | 10/2005 | Takaba | A43B 3/102 36/94 |
| 2010/0115793 | A1 | * | 5/2010 | Kraisosky | A43B 23/24 36/102 |
| 2011/0010963 | A1 | | 1/2011 | Webb | |
| 2013/0091732 | A1 | * | 4/2013 | Mendoza | A43B 3/0078 36/100 |
| 2013/0305562 | A1 | * | 11/2013 | Thatcher | A43B 13/141 36/83 |
| 2019/0275403 | A1 | | 9/2019 | Rudan | |
| 2019/0289957 | A1 | | 9/2019 | Lee | |
| 2020/0205522 | A1 | | 7/2020 | Dombrow et al. | |

FOREIGN PATENT DOCUMENTS

| | | | |
|---|---|---|---|
| EP | 2 710 988 | B1 | 11/2015 |
| JP | 48018330 | U1 | 3/1973 |
| JP | 9313206 | A2 | 12/1997 |
| JP | 3129336 | U | 2/2007 |
| KR | 930006040 | U | 4/1993 |
| KR | 20-0191565 | | 5/2000 |
| KR | 20-2012-0006986 | U | 10/2012 |
| KR | 10-217-0069409 | | 6/2017 |
| KR | 10-1789273 | B1 | 11/2017 |
| KR | 20170130913 | A | 11/2017 |
| WO | WO 2010/125862 | A1 | 11/2010 |
| WO | WO 2016/036187 | A1 | 10/2016 |

* cited by examiner

SHOE WITH IMPROVED STABILITY

BACKGROUND

Field

The present invention is directed to shoes, and more particularly to shoes with improved interstitial (e.g., between the toes) and toe reliant stabilization for feet.

Description of the Related Art

Shoe designs vary in construction, including the material of the upper and the sole, depending on its intended use (e.g., dress shoe, athletic shoe). Conventional shoes encase a foot, thereby providing exterior support for a foot. As a result, a foot still can move (e.g., shift, slide), sometimes loosely, within a shoe during ambulation. A user can tighten the shoe (e.g. by tightening shoe laces) to inhibit motion of the foot within the shoe, but this tightening of the encasement of the shoe over and around the foot results in added and unnecessary compression of the foot, which can constrict circulation in the foot, result in foot fatigue and/or cause discomfort.

Shoes can also be subjected to varying forces and stresses, depending on the user's activity. Athletic shoes, for example, can experience medial and lateral motion forces and/or quick rotational forces caused by the user's motion, or their pivoting about the toe portion of the shoe (e.g., while playing tennis). Such forces and stresses are borne solely by the exterior encasement of the shoe. Such forces can be concentrated and extreme due to any distal terminated movement of the foot within the shoe. For example, medial or lateral forces exerted on a conventional shoe by corresponding medial or lateral motion of the user's foot are borne by the medial or lateral sides of the shoe (e.g., especially at the lateral junction between the upper and the sole). Such forces and stresses can sometimes lead to failure of the shoe (e.g., at the lateral junction between the upper and the sole).

SUMMARY

In accordance with one aspect of the disclosure, there is a need for an improved shoe design with internal support for the user's foot that provides improved stability to the user's foot without relying solely on tightening the exterior encasement of the shoe around the user's foot.

In accordance with one aspect of the disclosure, there is a need for an improved shoe design with interstitial (e.g., between the toes) support for the user's foot that provides improved toe reliant stability to the user's foot.

In accordance with one aspect of the disclosure, there is a need for an improved shoe design with internal shoe support (e.g., interstitial or between the toes) for the user's foot that provides improved medial-lateral performance of the shoe during a medial or lateral initiation or termination of motion by the user.

In accordance with one aspect of the disclosure, there is a need for an improved shoe design with internal support for the user's foot that provides forward impedance for improved stability to a user's foot when moving on a decline or downhill or when braking while moving (e.g., walking, running, hiking) on a level surface, which can advantageously inhibit (e.g., prevent) pain from toe percussion into the toe box of the shoe.

In accordance with one aspect of the disclosure, there is a need for an improved shoe design with internal support for the user's foot that provides improved rotational performance of the shoe during the initiation or termination of a pivoting motion (e.g., clockwise or counterclockwise) by the user. Such improved design can accelerate the initiation of motion through the footbed as well as accelerate the termination of motion.

In accordance with another aspect of the disclosure, a shoe is provided that comprises a sole and an upper attached to the sole about a circumference of the sole, the upper and sole defining an interior space configured to receive a human foot therein. The shoe also comprises two to four posts of flexible non-elastic material disposed in a forefoot portion of the interior space. The posts extend between and are attached to the upper and to the sole, the posts spaced apart from a front end of the shoe. The posts are configured to extend into gaps between the toes and be positioned proximate (e.g., at or next to) vertices of the gaps between the toes. One or more of the posts is configured to be disposed on a medial side of a center or third toe of the foot when the shoe is in use, and one or more of the posts is configured to be disposed on a lateral side of the center or third toe of the foot when the shoe is in use. The posts are configured to match the arc of the vertices of the toes and configured to distribute a load exerted by the foot during motion of the foot through to the upper and the sole of the shoe. The posts in combination with the corresponding toes inhibit motion of the foot inside the shoe in one or more of a medial direction, a lateral direction, an anterior direction, a clockwise rotational direction, and a counterclockwise rotational direction.

DETAILED DESCRIPTION

Figure 1:
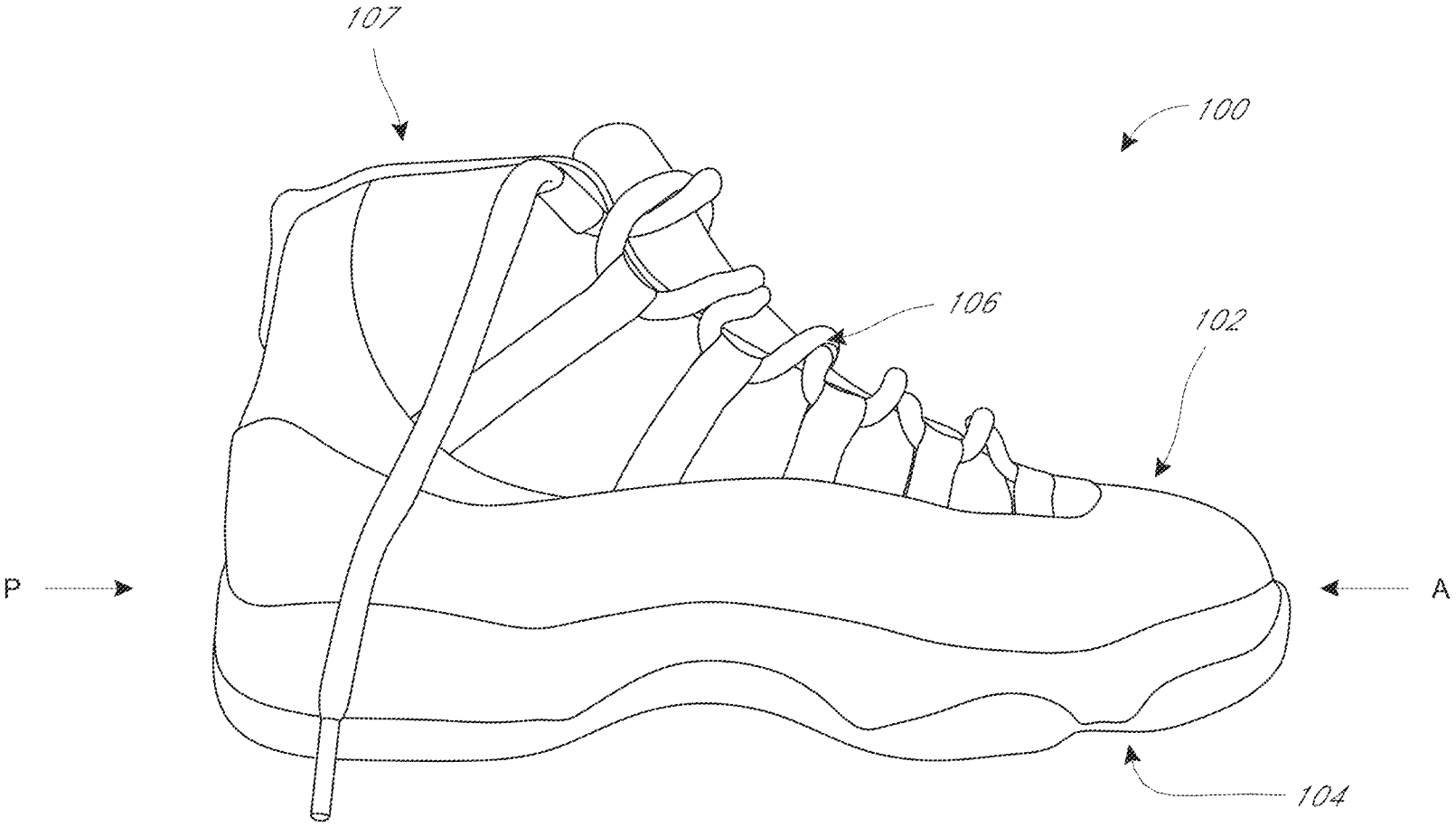
FIG. 1 is a schematic side view of a medial side of a left shoe.

FIGS. 1-9C show a shoe 100 with improved stability. Though some figures show a left shoe and other figures show a right shoe, one of skill in the art will recognize that the features disclosed below equally apply to a left shoe and a right shoe, where the left and right shoes 100 can be mirror images of each other. The shoe 100 can be an athletic shoe (e.g., a basketball shoe, tennis shoe, running shoe, swim bootie, climbing shoe, etc.). However, the features disclosed below equally apply to other shoe types (e.g., casual shoes, dress shoes, hiking shoes, soccer cleats, baseball cleats, etc.). The shoe 100 disclosed herein advantageously provides an internal support (e.g., interstitial or between the toes support) for a user's foot within the shoe 100 during ambulation (e.g., when moving or stopping medially or laterally, walking, hiking or running downhill, pivoting about a toe portion of the shoe 100, etc.) and, when in any performance shoe (e.g., an athletic shoe), can enhance athletic performance (e.g., reduce response times while initiating or terminating medial or lateral movement, or pivoting about the toe portion of the foot). As discussed further below, the shoe advantageously provides additional control surfaces (e.g., six control surfaces provided by four posts and medial/lateral inner sidewalls of the outer shell of the upper) that allow a user to start and stop more quickly when moving medial-laterally, moving forward (e.g., on a decline, on level ground) and/or pivoting about the toe portion of the shoe. The shoe also includes a heel counter (adjustable or unadjustable) that advantageously facilitates a snug fit for the shoe on the human foot and facilitates placement of the posts proximate (e.g., at or adjacent) the vertices (e.g., posterior ends of the gaps) between the toes, which provides a front to rear connection in the shoe that allows for accelerated initiation and termination of motion with the shoe. The snug fit provided by the shoe provides improved stability of the foot within the shoe without having to overly tighten laces or other fastening system of the shoe, thereby resulting in improved blood circulation in the foot and a reduction in foot fatigue during motion. The shoe can be used with a toe sock (e.g., sock that has separate compartments for each of the toes).

The shoe 100 has an upper 102 and a sole 104 (e.g., outer sole). The upper 102 can be attached to the sole 104 about a plan view circumference of the shoe 100 (e.g., the upper 102 is sewn and/or adhered to the sole 104 along a plan view circumference of the shoe 100). The upper 102 and sole 104 extend across a forefoot portion of the shoe 100 between a medial side M and a lateral side L of the shoe 100 (e.g., as a single continuous piece, as a patchwork of structural and/or visual design pieces that have a continuous connection). The shoe 100 can have an insole 105 that together with the upper 102 defines an interior space 107 that receives the user's foot. The shoe 100 can extend from a posterior end P and an anterior end A, and between a medial side M and a lateral side L. As used herein "posterior" or "posteriorly" means extending, facing or directed toward the posterior or rear end of the shoe 100, "anterior" or "anteriorly" means extending, facing or directed toward the anterior or front end of the shoe 100, "medial" or "medially" means extending, facing or directed toward the medial side of the shoe 100 (e.g., right side of a left shoe or left side of a right shoe as viewed from above), and "lateral" or "laterally" means extending, facing or directed toward the lateral side of the shoe 100 (e.g., left side of a left shoe or right side of a right shoe as viewed from above). Optionally, the shoe 100 can have one or more (e.g., a plurality of) laces 106 that a user can tie to adjust a tightening of the upper 102 of the shoe 100 on their foot F. In another implementation, the shoe 100 excludes laces and includes other mechanisms or systems for tightening the shoe onto a human foot.

Figure 2:
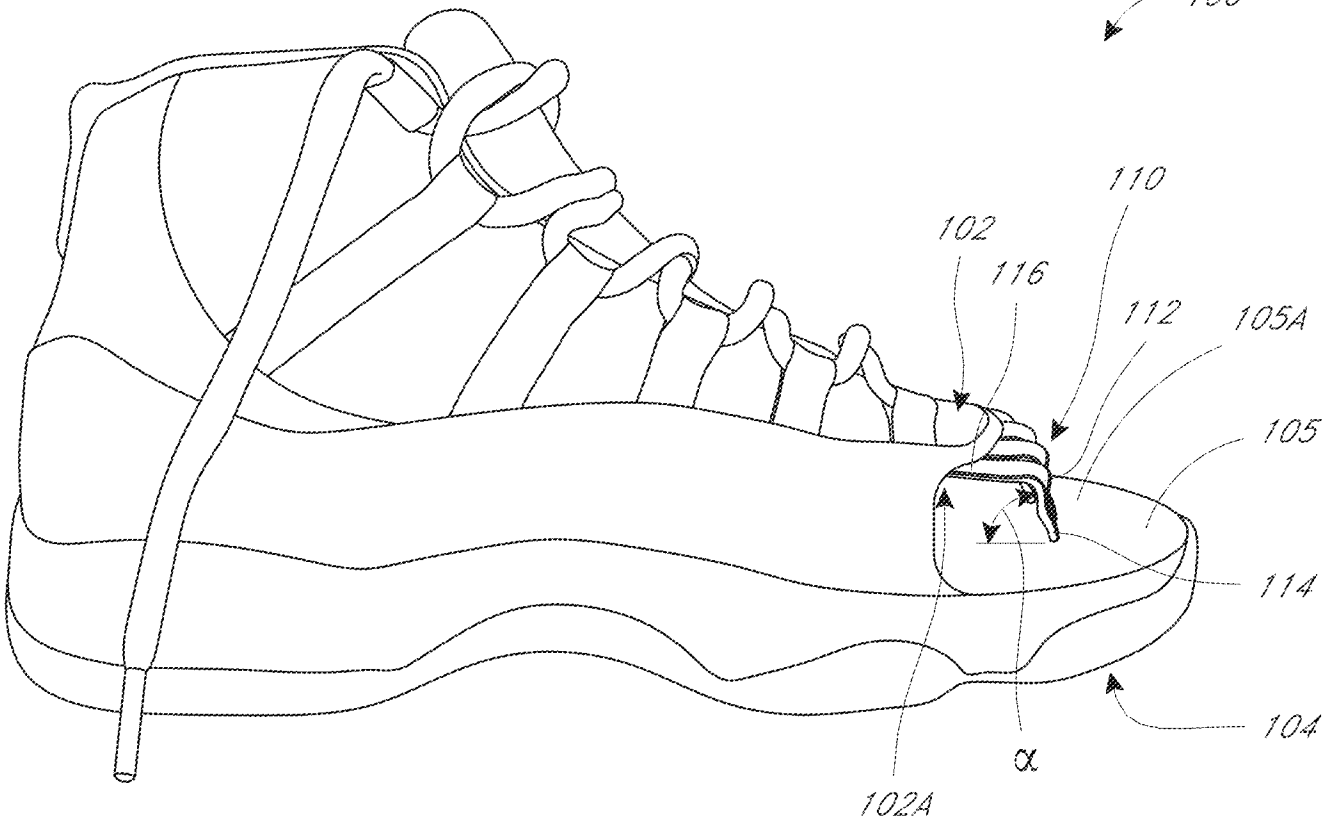
FIG. 2 is a schematic side view of the shoe of FIG. 1, with a front section of the upper removed to illustrate an interstitial toe reliant support structure inside the left shoe.
Figure 3:
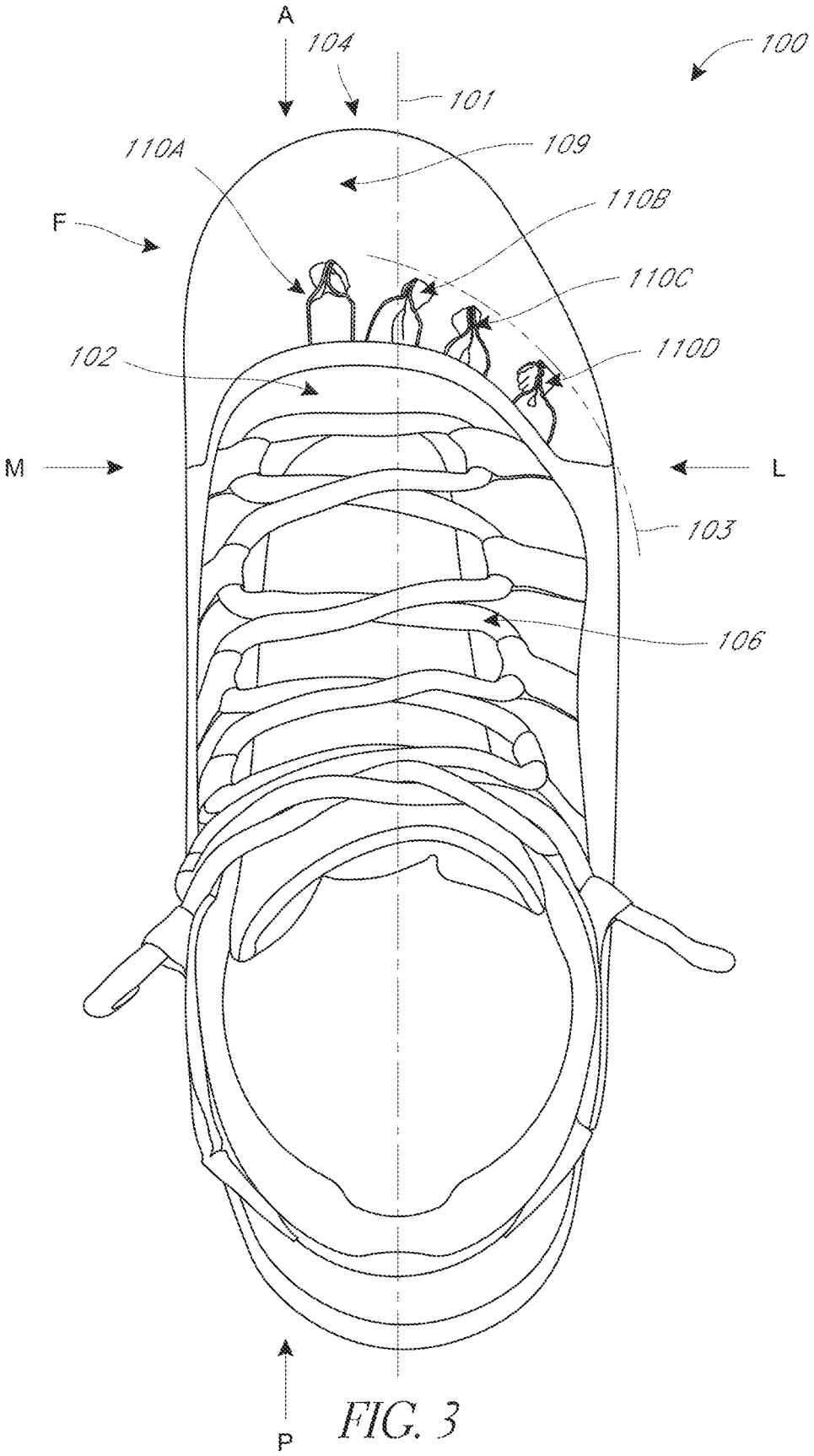
FIG. 3 is a schematic top view of a right shoe symmetrical to that of FIG. 1, with the front section of the upper removed to illustrate the interstitial toe reliant support structure inside the shoe.

With reference to FIGS. 2-3, the shoe 100 has a plurality of posts 110 that extend from and are attached to the upper 102 and the sole 104 and/or insole 105. The illustrated shoe 100 has four posts 110. However, in other implementations, the shoe 100 can have two to four posts 110 (e.g., two posts 110, three posts 110, four posts 110). In one implementation, the posts 110 can be straps of fabric. Preferably, the posts 110 are made of non-elastic material (e.g., substantially non-stretchable fabric, non-compressible or non-resilient material) that is advantageously flexible (e.g., not rigid), allowing the posts 110 to flex (e.g., bend) without stretching, as further discussed below. As used herein, substantially non-stretchable fabric means fabric that stretches less than 5% of its original length (e.g., when wet).

As best seen in FIG. 3, each of the posts 110 can in one implementation be defined by a folded fabric piece that is sewn along an anterior facing side opposite a posterior facing side of the posts 110. The posts 110 are sized to extend into the gaps between the toes of the user's foot such that the posterior facing side of the posts 110 is proximate (e.g., located at, located adjacent to, spaced from) vertices or posterior ends of such gaps between the toes of the foot, as further described below. Further, a heel of the shoe 100 (e.g., inner heel counter that is adjacent the foot's Achilles tendon and lower heel when the foot is in the shoe 100) is advantageously spaced from the posts 110 by a distance that facilitates the location of the posts 110 proximate (e.g., adjacent, next to) the vertices or posterior ends of the gaps between the toes of the foot, irrespective of the width of the foot or length of the toes for a particular foot size. The posts 110 and/or heel counter can advantageously facilitate a snug fit of the shoe on the foot (e.g., a fixed distance between the heel counter and the posts 110) for a given foot size, thereby making it unnecessary for the shoe 100 to be overly tightened (e.g., with laces) around the human foot, which advantageously allows improved blood flow during motion (e.g., avoiding constriction of blood flow and/or foot fatigue experienced from overly tightening a shoe around a foot).

Each post 110 has an elongate body 112 that extends between a first portion 114 adjacent an inner surface 105A of the insole 105 and a second portion 116 adjacent an inner surface 102A of the upper 102. As used herein, "inner" means facing toward the user's foot. In one implementation, the elongate body 112 extends between the insole 105 and the upper 102 at an angle $\alpha$ inclined posteriorly relative to the inner surface 105A of the insole 105 (e.g., when the shoe 100 is on a level surface in a neutral position), which advantageously allows more contact between the elongate body 112 and the user's foot (e.g., vertices between the toes) to provide support during motion, as further discussed below. In one implementation, the elongate body 112 can have an arcuate shape. The angle $\alpha$ can be between about fifty degrees and about sixty degrees relative to the inner surface 105A of the insole 105. In other implementations, the angle $\alpha$ can have other values (e.g., approximately 90 degrees relative to the inner surface 105A of the insole 105). In one implementation, the angle $\alpha$ of the elongate body 112 can vary for each of the posts 110. For example, the angle $\alpha$ for posts 110 can decrease toward the lateral side of the shoe 100. In another implementation, the angle $\alpha$ can be substantially the same for all the posts 110.

The post(s) 110 are preferably attached to (e.g., anchored) to the upper 102 and the sole 104 and/or insole 105 so that the first portion 114 and second portion 116 are fixed relative to the sole and/or insole 105 and to the upper 102, respectively. For example, the portions 116, 114 of the posts 110 can be sewn and/or adhered to the upper 102 and to the sole 104 and/or insole 105, respectively. In one implementation, the posts 110 can be molded or sewn (e.g., interwoven) into the upper 102 (e.g., outer shell of the upper 102) and/or sole 104 of the shoe 100. In one implementation, the first portion 114 can be anchored (e.g., molded) between an outer surface of the sole 104 and the inner surface 105A of the insole 105. The shoe 100 can have a multi-layer construction between the insole 105 and the sole or outsole 104, with the first portion 114 of the posts 110 anchored or molded between any two layers between the insole 105 and the outer surface of the outsole 104.

With continued reference to FIGS. 2-3, the posts 110 are disposed in a forefoot portion of the shoe 100 and spaced apart from (e.g., separated from, not in contact with) the anterior or front end A of the shoe 100 such that there is a space 109 between the posts 110 and the anterior end A of the shoe 100. The posts 110 (e.g., the elongate body 112 of the posts 110) are arranged so that they fit within the gaps between toes of the foot proximate (e.g., adjacent, next to, in contact with) the vertices or posterior ends of the gaps (e.g., the posts 110 do not extend between and contact the toe ends or phalanges of the foot since toe lengths vary, but instead contact the vertices or posterior ends of the gaps between toes). A first post 110A can fit in a gap between the large toe and the second toe in the foot (e.g., at or adjacent the vertex or posterior end of the gap between the large toe and the second toe). A second post 110B can fit in a gap between the second toe and a third toe (e.g., middle toe) in the foot (e.g., at or adjacent the vertex or posterior end of the gap between the second toe and the third toe). A third post 110C can fit in a gap between the third toe (e.g., middle toe) and a fourth toe in the foot (e.g., at or adjacent the vertex or posterior end of the gap between the third toe and the fourth toe). A fourth post 110D can fit in a gap between the fourth toe and a fifth toe (e.g. pinky toe) in the foot (e.g., at or adjacent the vertex or posterior end of the gap between the fourth toe and the fifth toe).

Advantageously, the posts 110 inhibit (e.g., prevent) shifting or sliding of the foot inside the shoe 100 during, but not limited to, the initiation or termination of lateral or medial motion of the foot, as well as inhibit (e.g., prevent) shifting or sliding of the foot anteriorly inside the shoe 100 (e.g., provide forward impedance while walking, hiking or running downhill or on level ground, or quickly stopping a forward motion), as further discussed below. As discussed above, the heel of the shoe 100 (e.g., inner heel counter that is adjacent the foot's Achilles tendon and lower heel when the foot is in the shoe 100) is advantageously spaced from the posts 110 by a distance that facilitates the location of the posts 110 proximate (e.g., adjacent, next to, in contact with) the vertices or posterior ends of the gaps between the toes of the foot, irrespective of the width of the foot or length of the toes for a particular foot size.

The first portions 114 are arranged on the insole 105 along a trajectory 103 that is non-perpendicular to a longitudinal axis (e.g., central axis) 101 of the shoe 100 and generally coincides with a boundary between phalanges and metatarsals in a human foot. In one implementation, the posts 110 (e.g., first portions 114) can be arranged along an arc or curved trajectory 103 that forms a plan view of the mean of toe vertices with their projected locations onto the insole platform 105 of any shoe averaged over any particular size and width, which have been found to be consistent with foot size and width and irrespective of toe length. For example, the first post 110A is disposed further anteriorly than the rest of the posts 110B-110D, the second post 110B is disposed further anteriorly than the third and fourth posts 110C, 110D, and the third post 110C is disposed further anteriorly than the fourth post 110D.

As discussed above, the shoe 100 can have two to four posts 110. Preferably, at least one post 110 is disposed on a medial side of a center or middle toe of the user's foot when it is inserted into the shoe 100 and at least one post is disposed on a lateral side of the center or middle toe of the user's foot when it is inserted into shoe 100, which advantageously inhibits (e.g., prevents) shifting or sliding of the foot relative to the upper 102 or sole 104 when the foot pivots about the toe portion of the shoe 100, as further discussed below. For example, in implementations where the shoe 100 has only two posts 110, the posts can be the first post 110A that fits between the large toe and the second toe and the third post 110C that fits between the third toe and the fourth toe, or can be the first post 110A and the fourth post 110D that fits between the fourth toe and the fifth toe, or can be the second post 110B and the third post 110C. In implementations where the shoe 100 has three posts 110, the posts can be the first post 110A, second post 110B and third post 110C, or the first post 110A, second post 110B and fourth post 110D, or the first post 110A, third post 110C and fourth post 110D.

Figure 4:
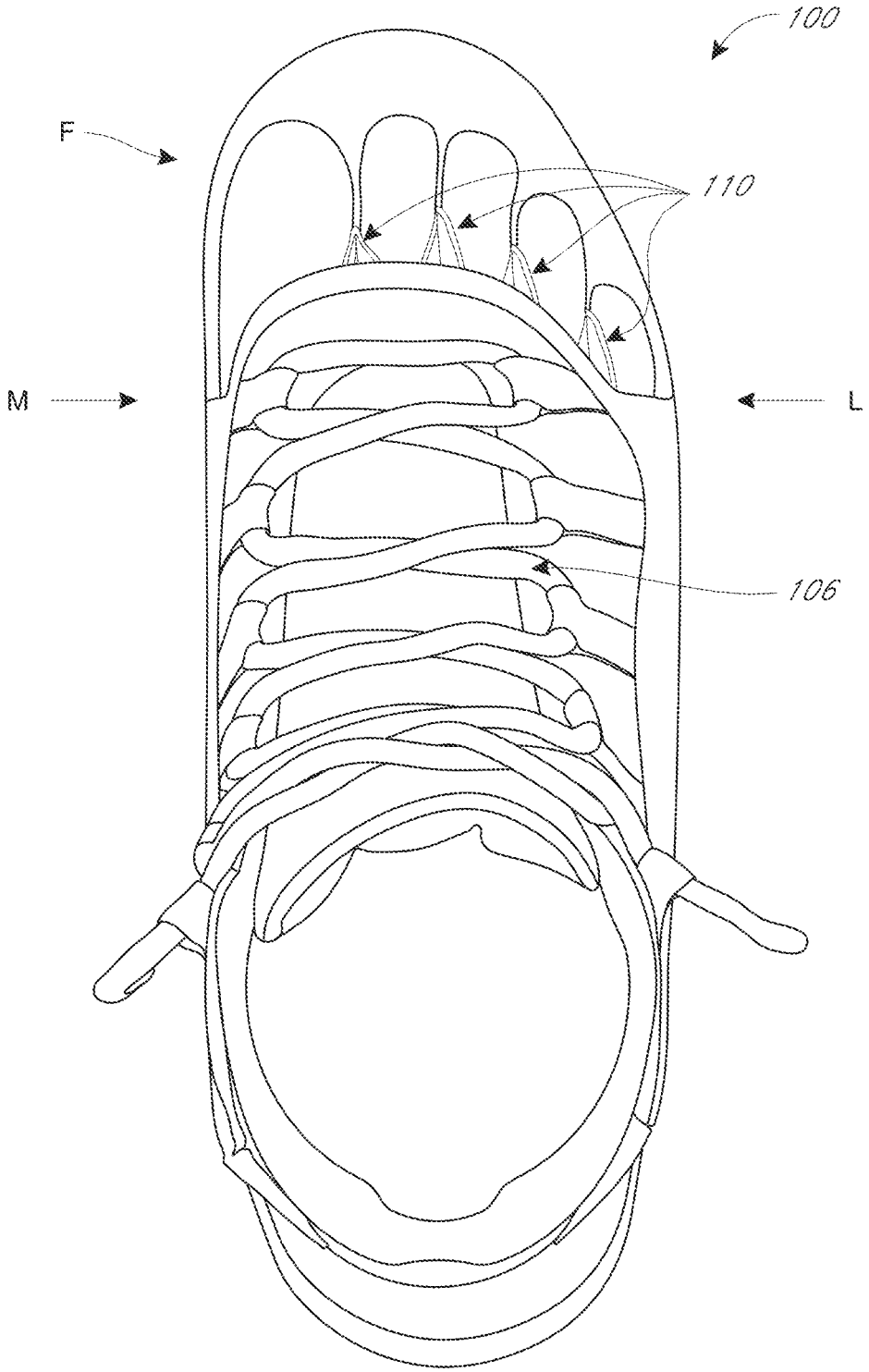
FIG. 4 is a schematic top view of the right shoe of FIG. 3, with the front section of the upper removed to illustrate the interstitial toe reliant support structure inside the shoe, and a human foot inside the shoe in a neutral position.
Figure 5:
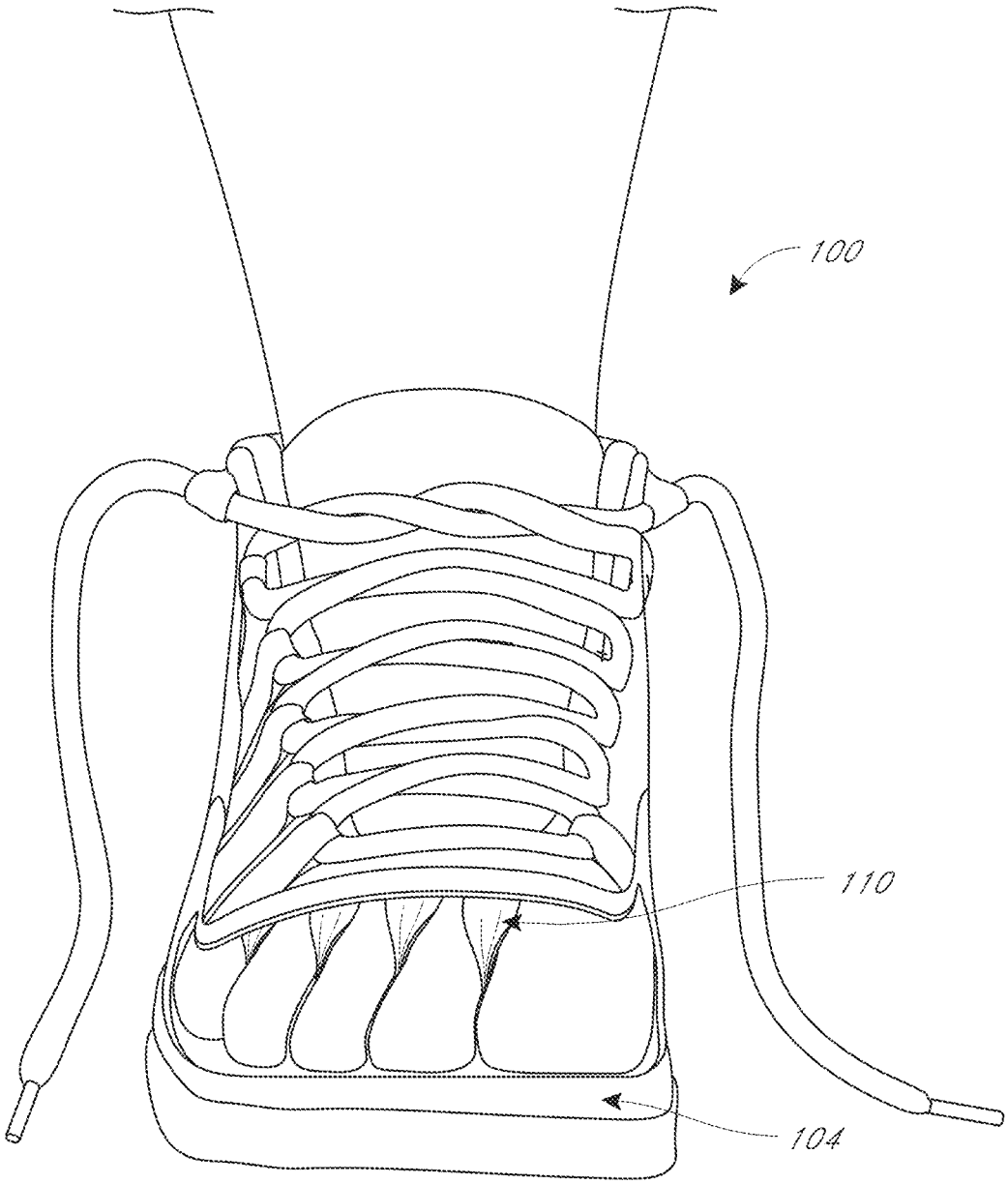
FIG. 5 is a schematic front view of the right shoe in FIG. 4, with the front section of the upper removed to illustrate the interstitial toe reliant support structure inside the shoe, and the foot inside the shoe in the neutral position.

FIGS. 4-5 show a cutaway in the upper of the shoe 100 with the foot in a neutral position (e.g., standing upright on an even or level surface). The posts 110 extend between the toes of the foot proximate (e.g., adjacent, next to, in contact with) the vertices or posterior ends of gaps between the toes, while allowing the ends of the toes to move relative to each other. The posts 110 support the foot to inhibit (e.g., limit) medial or lateral movement of the foot within the shoe 100 (e.g., within the interior space 107) when the user moves medially or laterally by exerting a counterforce on the foot (e.g., via the contact between the posts 110 and the toes of the foot). Advantageously, the posts 110 allow a load (e.g., a lateral or medial force applied by a user during quick or sudden shifts in motion) to be distributed throughout the upper 102 and the sole 104 and not be concentrated in a particular portion of the outer shell of the shoe 100 (e.g., the lateral junction between the upper 102 and sole 104), allowing the shoe 100 to better support the foot and inhibit (e.g. prohibit) the foot from slipping inside the shoe 100. Because the posts 110 are attached (e.g., anchored) to the upper 102 and sole 104 and/or insole 105, lateral or medial forces (e.g., from an athlete suddenly shifting in one direction, such as, for example, in basketball or tennis) will advantageously be borne not just by the posts 110 but also transferred to the upper 102 and sole 104 and/or insole 105, allowing more of the shoe 100 to support the foot during medial or lateral motion and inhibiting (e.g., preventing) that a single portion of the shoe 100 (e.g., lateral seam between upper 102 and sole 104) bear all of the lateral or medial load, which might lead to failure of the shoe (e.g., tearing between the lateral seam between the upper 102 and sole 104) and possible injury to the individual (e.g., ankle sprain and/or knee sprain from a lateral slip within the shoe or due to a sidewall blowout).

Where the shoe 100 has four posts 110, the shoe provides six control surfaces (e.g., the four posts, the medial inner wall of the outer shell of the upper and the lateral inner wall of the outer shell of the upper) that bear on the foot during medial or lateral motion to inhibit (e.g., prevent) motion of the foot within the shoe. Such an increase in control surfaces of the shoe 100 allow a user (e.g., athlete) to initiate and terminate a sideway or forward motion (e.g., medial motion, lateral motion, forward motion) more quickly, as well as allows a user to initiate or terminate a pivoting action more quickly. This is because unlike conventional shoes where the foot must first move into contact with the inner wall of the outer shell of the shoe (e.g., when moving laterally) before changing direction, the additional (e.g., four) control surfaces in the shoe 100 inhibit (e.g., prevent, stop) the motion of the foot within the shoe 100 more quickly, allowing the user to initiate or terminate a motion more quickly or change direction.

Figure 6A:
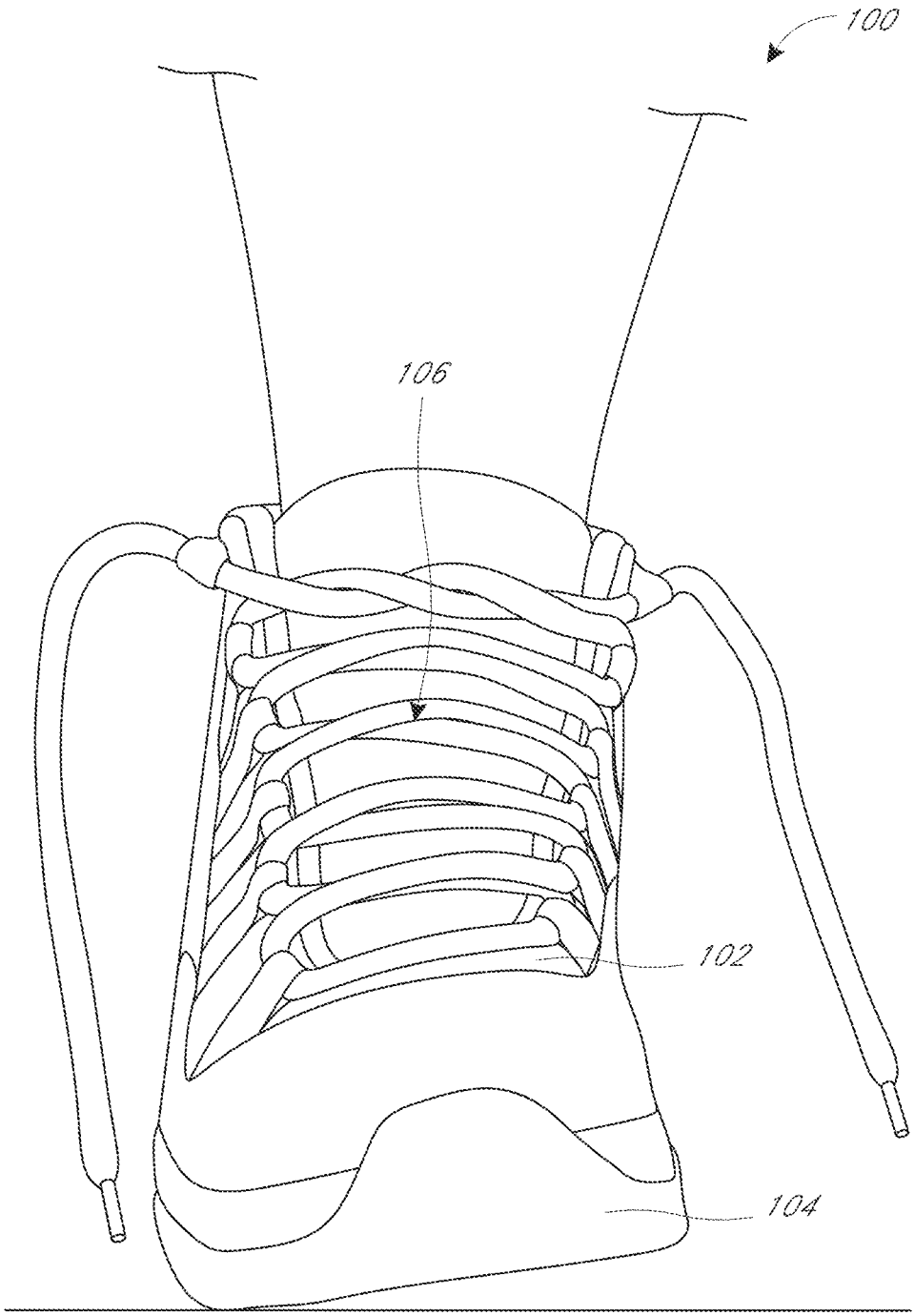
FIG. 6A is a schematic front view of the right shoe in FIG. 3 with the user's leg inclined in a medial direction so that the foot applies a lateral force on the shoe.
Figure 6B:
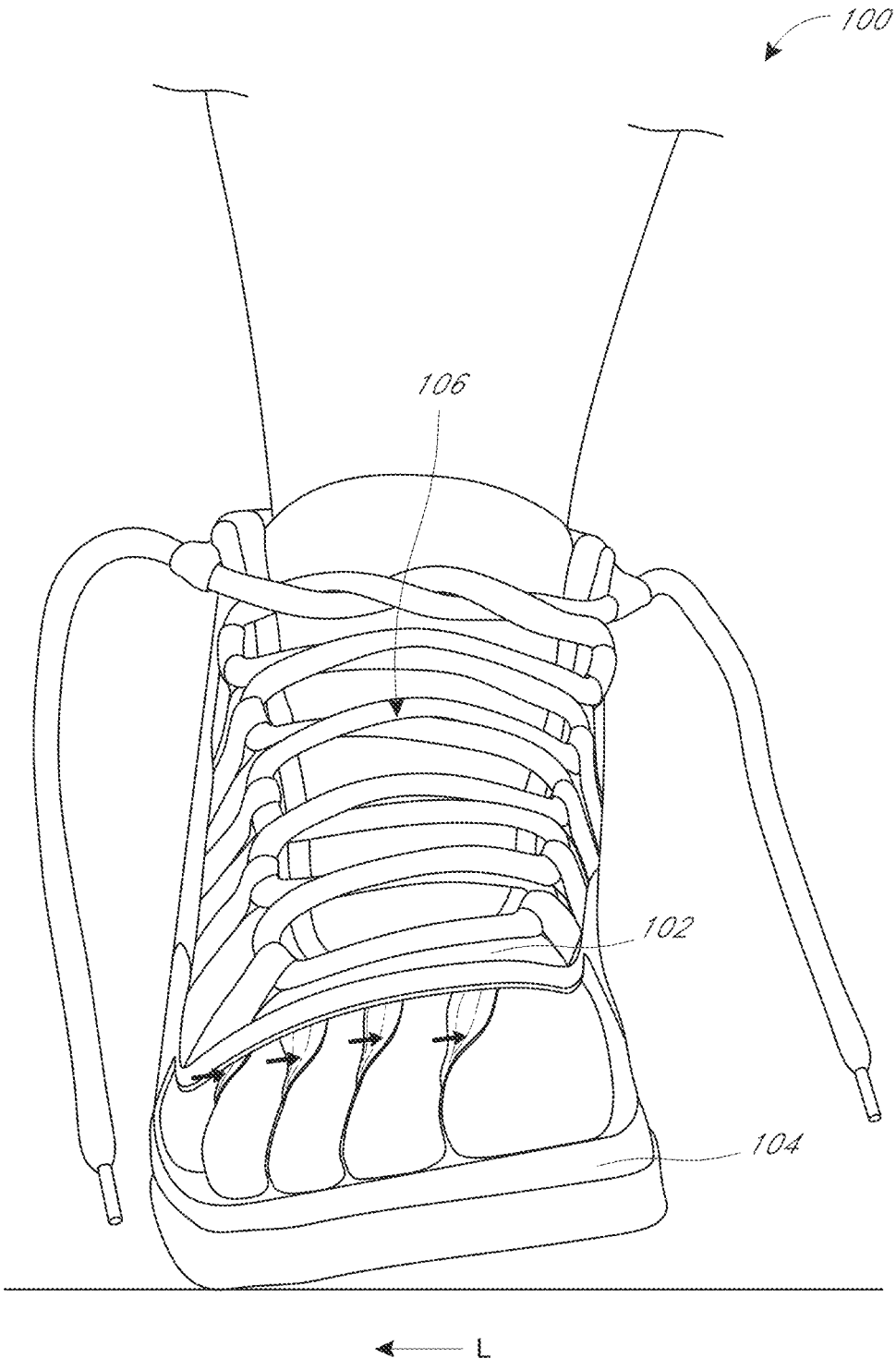
FIG. 6B is a schematic front view of the right shoe in FIG. 6A, with the front section of the upper removed to illustrate the interstitial toe reliant support structure inside the shoe, the user's leg inclined in the medial direction so that the foot applies a lateral force on the shoe.

FIGS. 6A-6B shows the shoe 100 during a lateral motion of the foot. As shown in the cutaway view of the upper 102 in FIG. 6B, during such lateral motion, the foot attempts to shift toward the lateral side L of the shoe 100 due to a lateral force applied by the user on their foot. The posts 110 advantageously apply a counterforce (e.g., in the medial direction, as illustrated by the arrows in FIG. 6B) against the toes to inhibit (e.g., limit) a shifting of the foot inside the shoe 100 and take up at least a portion of (e.g., a majority of, a substantial portion of) the applied lateral force, which is advantageously distributed to the upper 102 and sole 104 and/or insole 105 via the posts 110. The lateral inner wall of the outer shell of the upper 102 also applies a force on the fifth or pinky toe in a medial direction. As the posts 110 are of flexible and non-elastic material (e.g., substantially non-stretchable material, non-resilient material), the posts 110 extend at least partially over and exert the counterforce on lateral sides of the first to fourth toes. In one implementation, each of the posts 110 applies a generally equal amount of force to the four toes to counter the lateral force on the foot. In another implementation, at least two of the posts 110 apply different amounts of force to their adjacent toes. In another implementation, the first post 110A exerts a larger force on the first toe than the second post 110B exerts on the second toe, which is larger than the force the third post 110C exerts on the third toe, with the fourth post 110D exerting a relatively smaller force on the fourth toe.

Figure 7A:
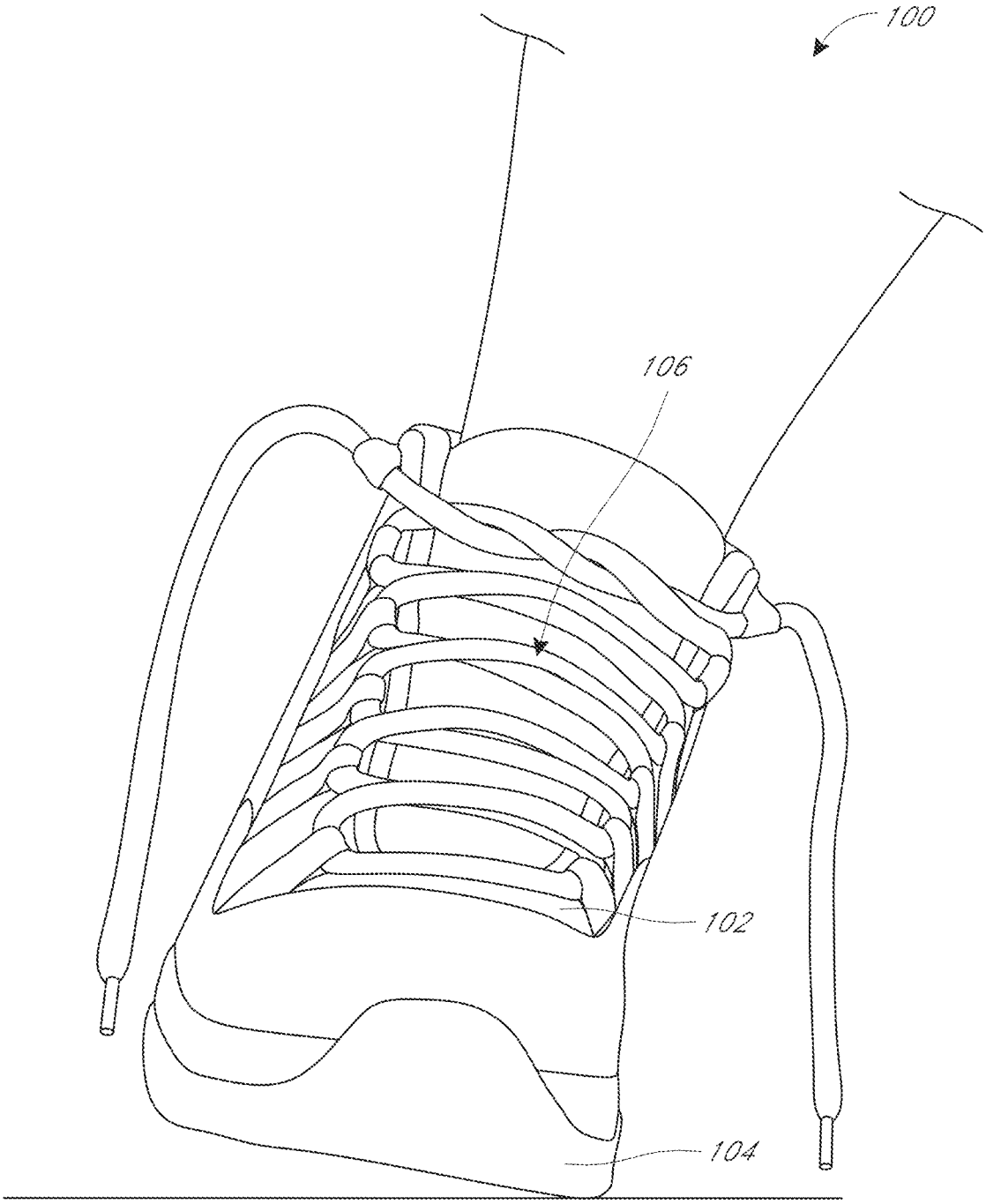
FIG. 7A is a schematic front view of the right shoe in FIG. 3 with the user's leg inclined in a medial direction so that the foot applies a medial force on the shoe.
Figure 7B:
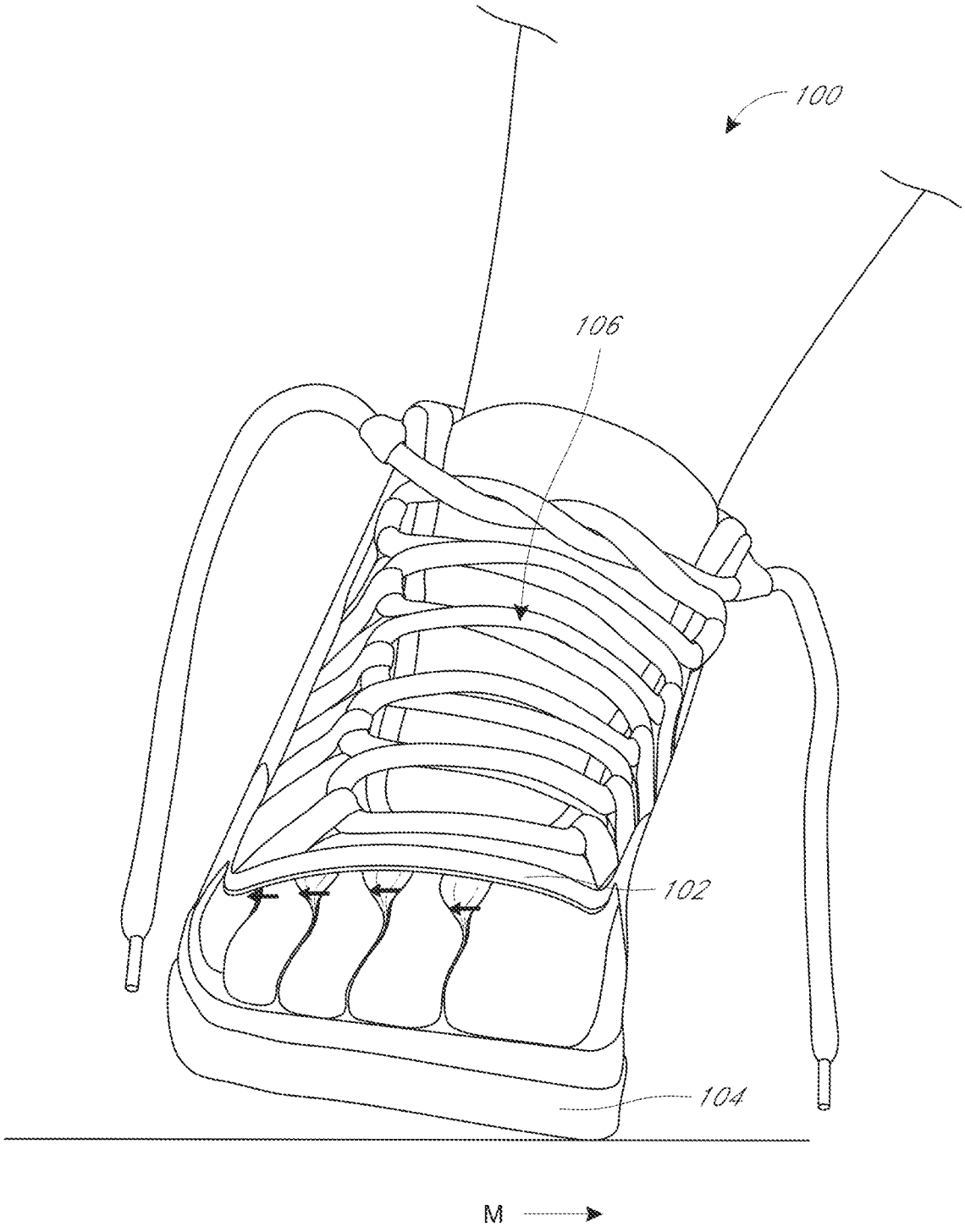
FIG. 7B is a schematic front view of the right shoe in FIG. 7A, with the front section of the upper removed to illustrate the interstitial toe reliant support structure inside the shoe, the user's leg inclined in the medial direction so that the foot applies a medial force on the shoe.

FIGS. 7A-7B shows the shoe 100 during a medial motion of the foot. As shown in the cutaway view of the upper 102 in FIG. 7B, during such medial motion, the foot attempts to shift toward the medial side M of the shoe 100 due to a medial force applied by the user on their foot. The posts 110 advantageously apply a counterforce (e.g., in the lateral direction, as illustrated by the arrows in FIG. 7B) against the toes to inhibit (e.g., limit) a shifting of the foot inside the shoe 100 and take up at least a portion of (e.g., a majority of, a substantial portion of) the applied medial force, which is advantageously distributed to the upper 102 and sole 104 and/or insole 105 via the posts 110. The medial inner wall of the outer shell of the upper 102 also applies a force on the first or big toe in a lateral direction. As the posts 110 are of flexible and non-elastic material (e.g., substantially non-stretchable material, non-resilient material), the posts 110 extend at least partially over and exert the counterforce on medial sides of the second to fifth toes. In one implementation, each of the posts 110 applies a generally equal amount of force to the four toes to counter the medial force on the foot. In another implementation, at least two of the posts 110 apply different amounts of force to their adjacent toes. In another implementation, the first post 110A exerts a larger force on the second toe than the second post 110B exerts on the third toe, which is larger than the force the third post 110C exerts on the fourth toe, with the fourth post 110D exerting a relatively smaller force on the fifth toe.

Figure 8A:
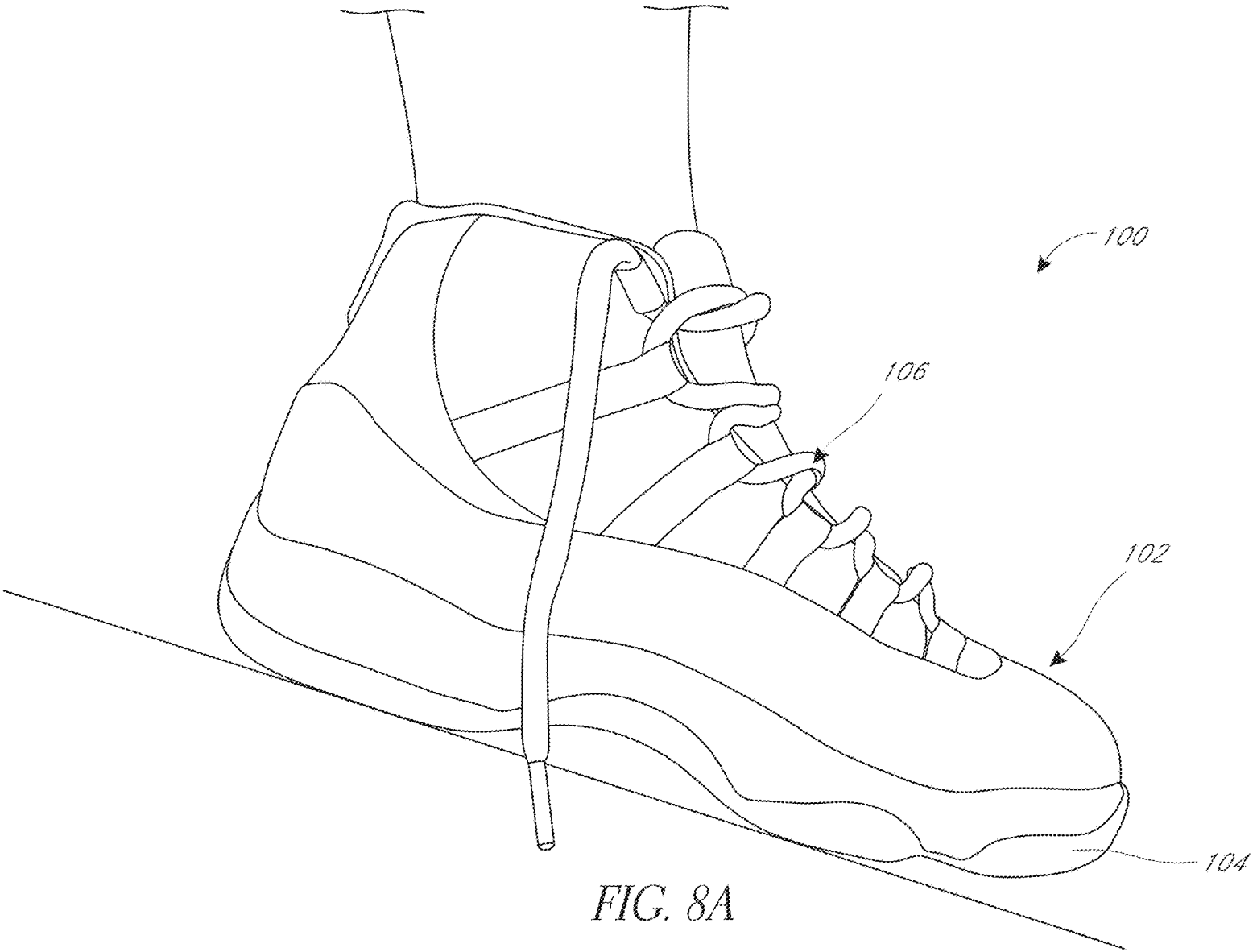
FIG. 8A is a schematic side view of the left shoe in FIG. 1 on a decline, with the user's leg inclined in a posterior direction so that the foot applies an anterior force on the shoe.
Figure 8B:
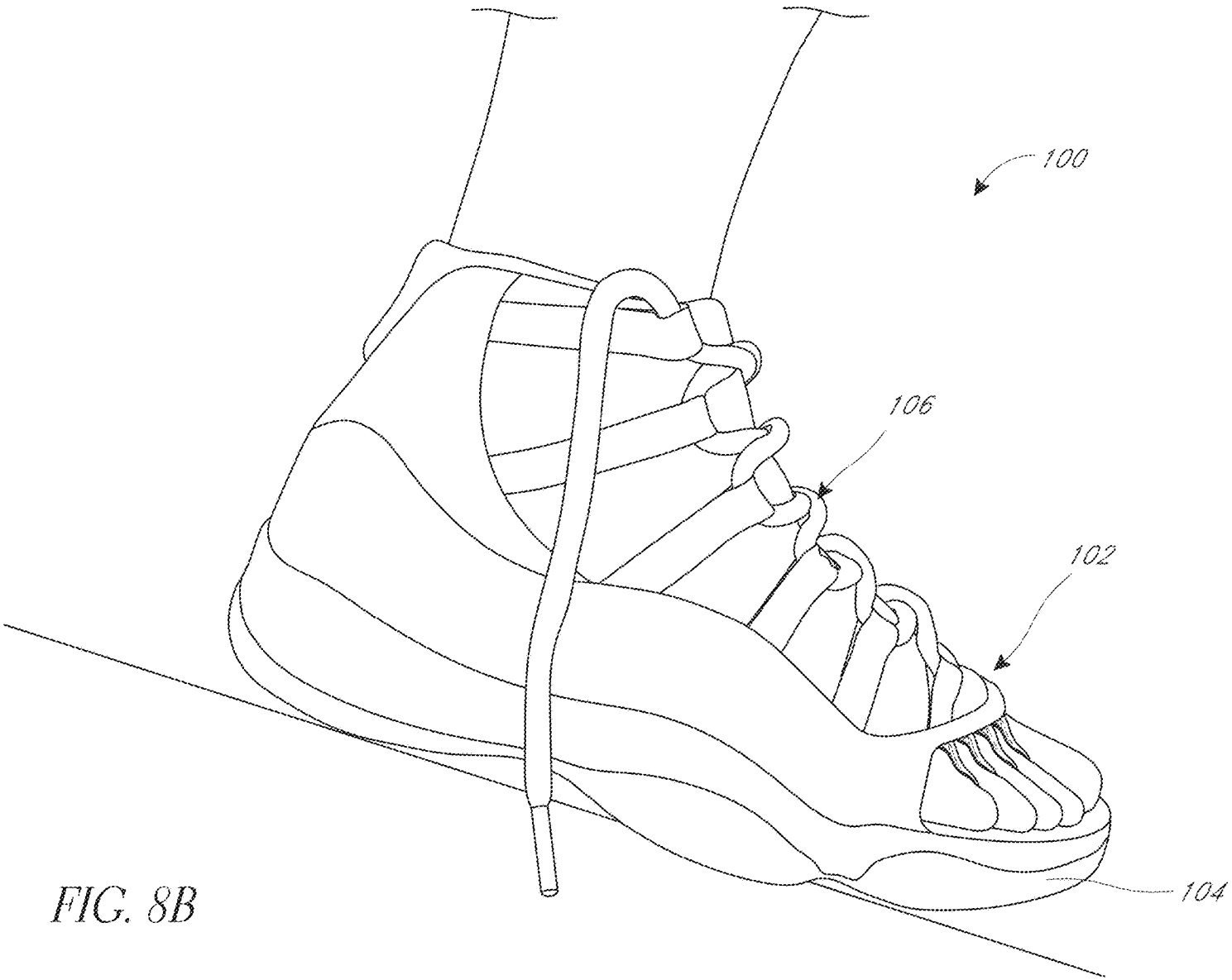
FIG. 8B is a schematic side view of the right shoe symmetrical to that in FIG. 8A, with the front section of the upper removed to illustrate the interstitial toe reliant support structure inside the shoe, the user's leg inclined in the posterior direction so that the forefoot applies an anterior force on the shoe.
Figure 8C:
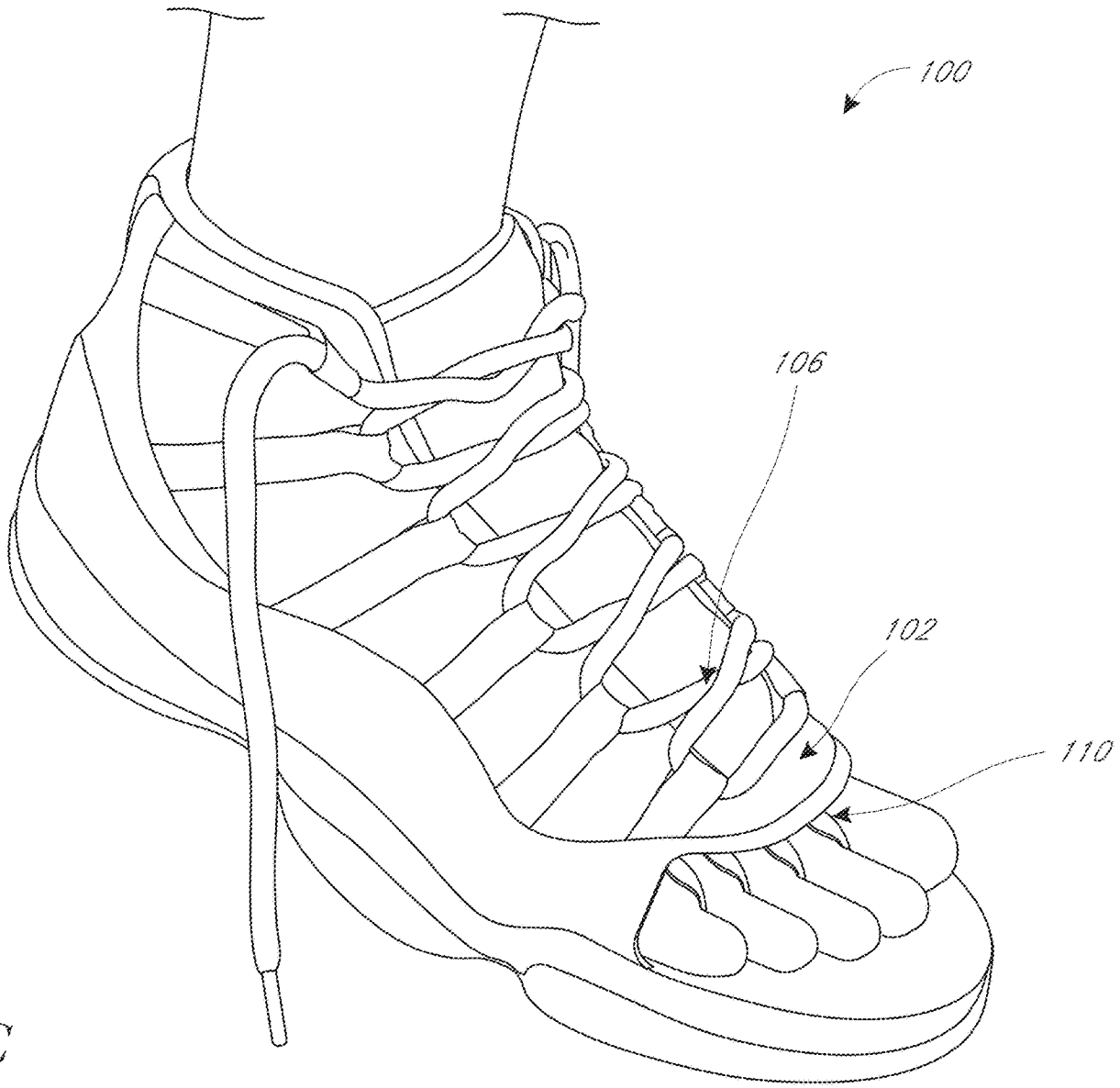
FIG. 8C is a schematic perspective view of the right shoe in FIG. 8B.

FIGS. 8A-8C shows the shoe 100 during motion (e.g., walking, hiking, running) on a decline (e.g., downhill, such as when hiking down a trail), which also apply to a forward motion with the shoe 100 (e.g., when initiating or terminating a forward motion on a level surface or a downhill surface). As shown in the cutaway views of the upper 102 in FIGS. 8B-8C, during such downhill motion, the foot attempts to shift toward the anterior end A of the shoe 100. The posts 110 advantageously apply a counterforce (e.g., in the posterior direction) against the toes to inhibit (e.g., limit) a shifting of the foot inside the shoe 100 (e.g., provide forward impedance) and take up at least a portion of (e.g., a majority of, substantially all of) the anterior force on the foot, which is distributed to the upper 102 and sole 104 and/or insole 105 via the posts 110. Therefore, the posts 110 provide forward impedance support to the foot to inhibit (e.g. prevent) the toe ends from contacting the anterior end of the shoe 100 (e.g., the shoe box) during such downhill motion (e.g., walking downhill, hiking downhill, running downhill), or when initiating or terminating a forward motion on a level surface or a downhill surface, which can result in pain or discomfort in the foot (e.g., toes of the feet), such as during prolonged motion downhill (e.g., a long or steep hike or run downhill). As the posts 110 are of flexible and non-elastic material (e.g., substantially non-stretchable material, non-resilient material), the posts 110 extend at least partially over and exert the counterforce on a top portion of the foot. In one implementation, each of the posts 110 applies a generally equal amount of force to counter the anterior force on the foot. In another implementation, at least two of the posts 110 apply a different amount of force on the foot. Such forward impedance facilitated by the posts 110 also allows a user to stop faster when running on level ground, as the posts 110 inhibit (e.g., prevent) forward motion of the foot within the shoe 100.

Figure 9A:
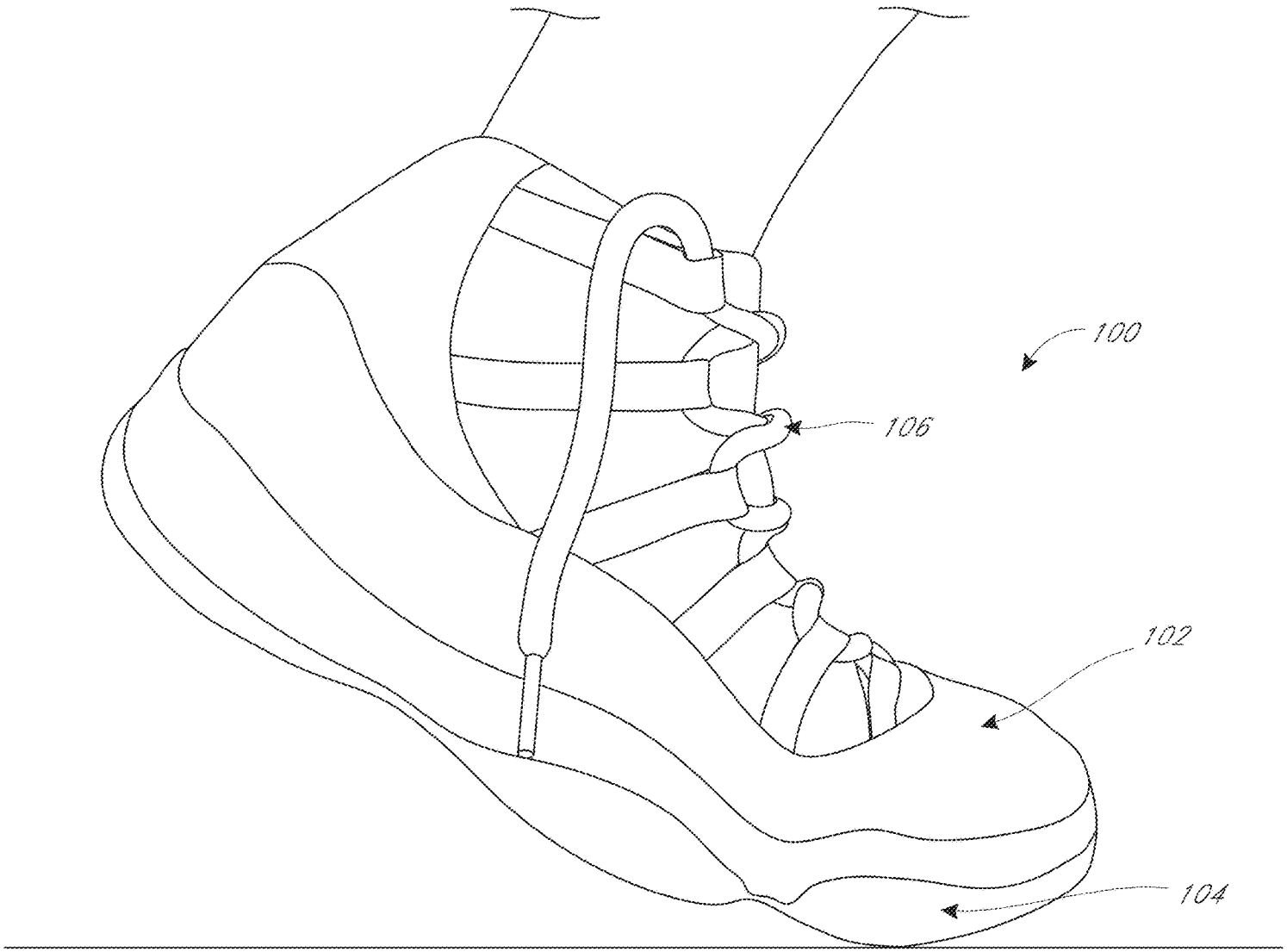
FIG. 9A is a schematic side view of the right shoe in FIG. 3 with the user's heel raised and the user pivoting about the toe portion of the shoe.
Figure 9B:
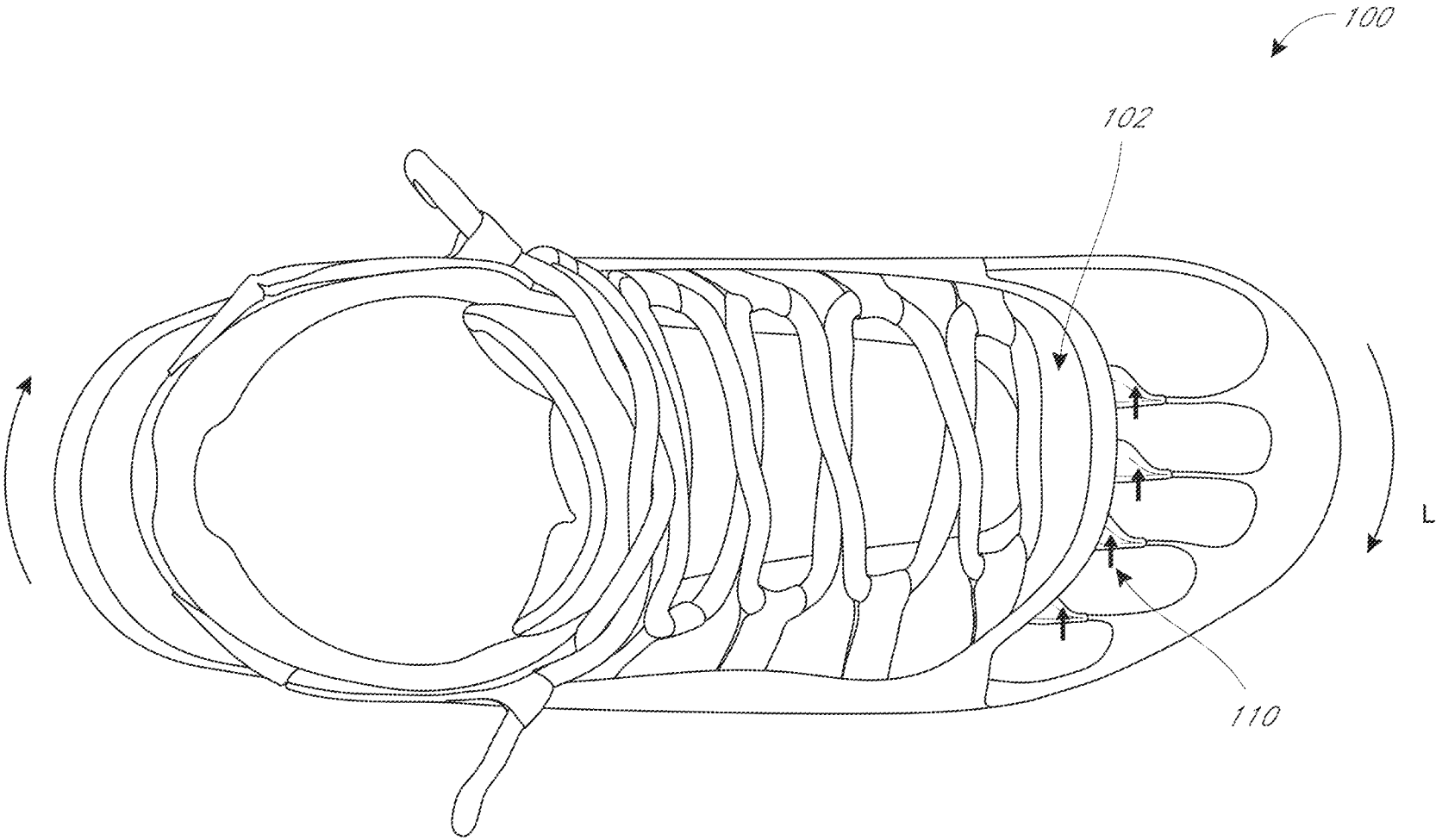
FIG. 9B is a schematic top view of the right shoe of the shoe of FIG. 9A, with the front section of the upper removed to illustrate the interstitial toe reliant support structure inside the shoe, and a forefoot inside the shoe rotating laterally and heel inside the shoe rotating medially.
Figure 9C:
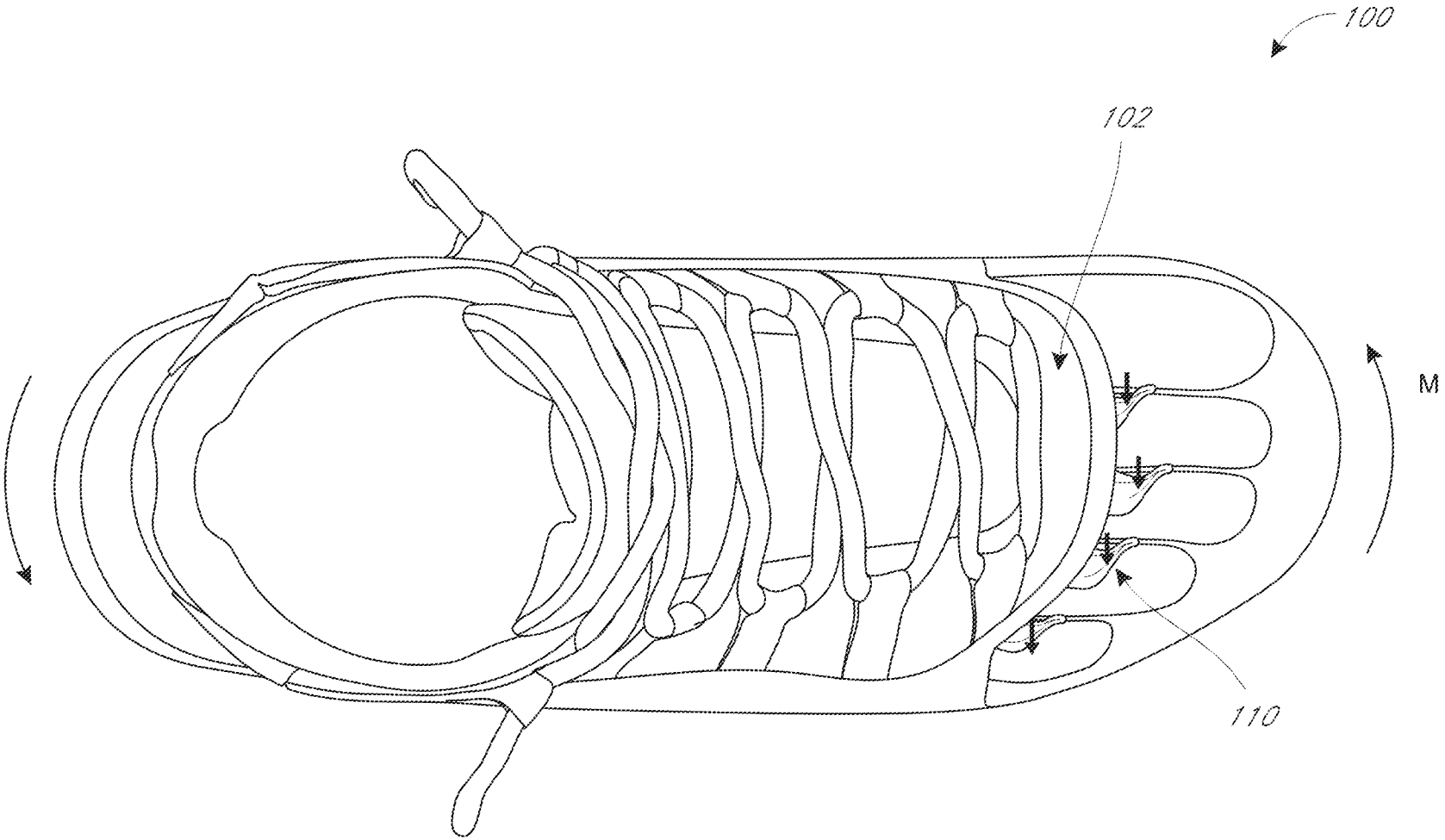
FIG. 9C is a schematic top view of the shoe of the right shoe of FIG. 9A, with the front section of the upper removed to illustrate the interstitial toe reliant support structure inside the shoe, and a forefoot inside the shoe rotating medially and heel inside the shoe rotating laterally.

FIGS. 9A-9C shows the shoe 100 during a pivoting motion about the toe portion of the shoe 100 (e.g., a basketball or tennis player pivoting around on their toes). The posts 110 advantageously provide a rotational support structure to the toes to inhibit (e.g., limit) rotation of the foot within the shoe 100 when the user initiates or terminates a clockwise or counterclockwise pivoting motion about the toe portion of the shoe 100.

FIG. 9B shows the shoe 100 rotating laterally L (e.g., clockwise in a right foot), in which the forefoot attempts to rotate laterally within the shoe 100 due to a lateral rotational force applied by the user on their foot while the heel of the foot attempts to rotate medially within the shoe 100. The posts 110 apply a counter-rotational force (e.g., toward the medial direction, as illustrated by the arrows in FIG. 9B) against the toes to inhibit (e.g., limit) a rotation of the foot within the shoe 100 and take up at least a portion of (e.g., a majority of, a substantial portion of) the applied lateral rotational force, which is advantageously distributed to the upper 102 and sole 104 and/or insole 105 via the posts 110. The lateral inner wall of the outer shell of the upper 102 also applies a force on the fifth or pinky toe in a medial direction. As the posts 110 are of flexible and non-elastic material (e.g., substantially non-stretchable material, non-resilient material), the posts 110 extend at least partially over and exert the counter-rotational force on a lateral side of the first to fourth toes. In one implementation, each of the posts 110 applies a generally equal amount of counter-rotational force to the four toes to counter the lateral rotational force on the foot. In another implementation, at least two of the posts 110 apply a different force on their adjacent toes. In another implementation, the first post 110A exerts a larger rotational force on the first toe than the second post 110B exerts on the second toe, which is larger than the rotational force the third post 110C exerts on the third toe, with the fourth post 110D exerting a relatively smaller rotational force on the fourth toe.

FIG. 9C shows the shoe 100 rotating medially M (e.g., counter-clockwise in a right foot), in which the forefoot attempts to rotate medially within the shoe 100 due to a medial rotational force applied by the user on their foot while the heel of the foot attempts to rotate laterally within the shoe 100. The posts 110 apply a counter-rotational force (e.g., toward the lateral direction, as illustrated by the arrows in FIG. 9C) against the toes to inhibit (e.g., limit) a rotation of the foot within the shoe 100 and take up at least a portion of (e.g., a majority of, a substantial portion of) the applied medial rotational force, which is advantageously distributed to the upper 102 and sole 104 and/or insole 105 via the posts 110. The medial inner wall of the outer shell of the upper 102 also applies a force on the first or big toe in a lateral direction. As the posts 110 are of flexible and non-elastic material (e.g., non-stretchable material, non-resilient material), the posts 110 extend at least partially over and exert the counter-rotational force on a medial side of the second to fifth toes. In one implementation, each of the posts 110 applies a generally equal amount of counter-rotational force to the toes to counter the medial rotational force on the foot. In another implementation, at least two of the posts 110 apply a different force on their adjacent toes. In another implementation, the first post 110A exerts a larger rotational force on the second toe than the second post 110B exerts on the third toe, which is larger than the rotational force the third post 110C exerts on the fourth toe, with the fourth post 110D exerting a relatively smaller rotational force on the fifth toe.

Figure 10A:
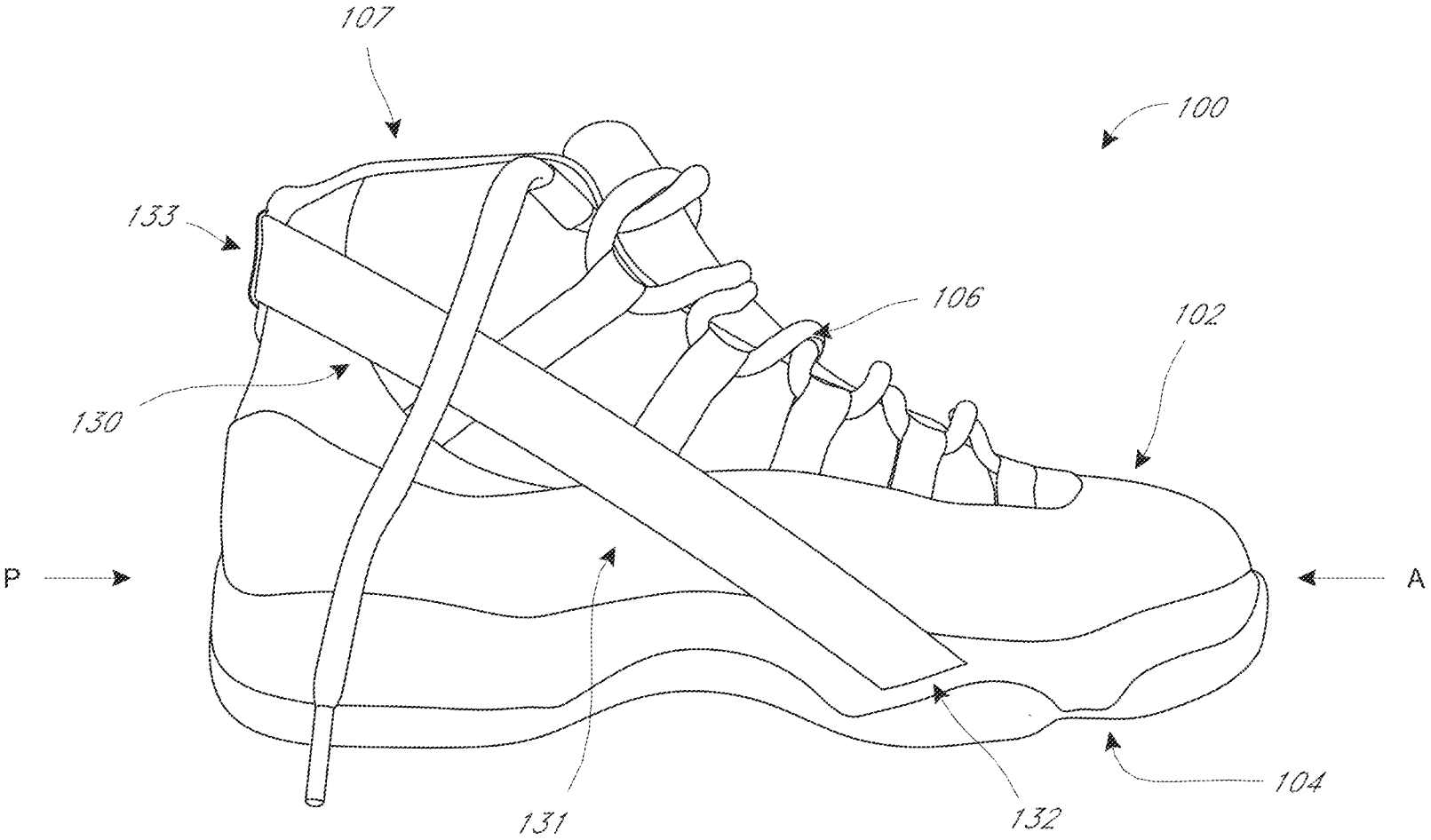
FIG. 10A is a schematic view of a medial side of a left shoe with an adjustable strap around a rear portion of the shoe that is adjustable by a user to adjust a tightness of a heel counter of the shoe about the user's heel.
Figure 10B:
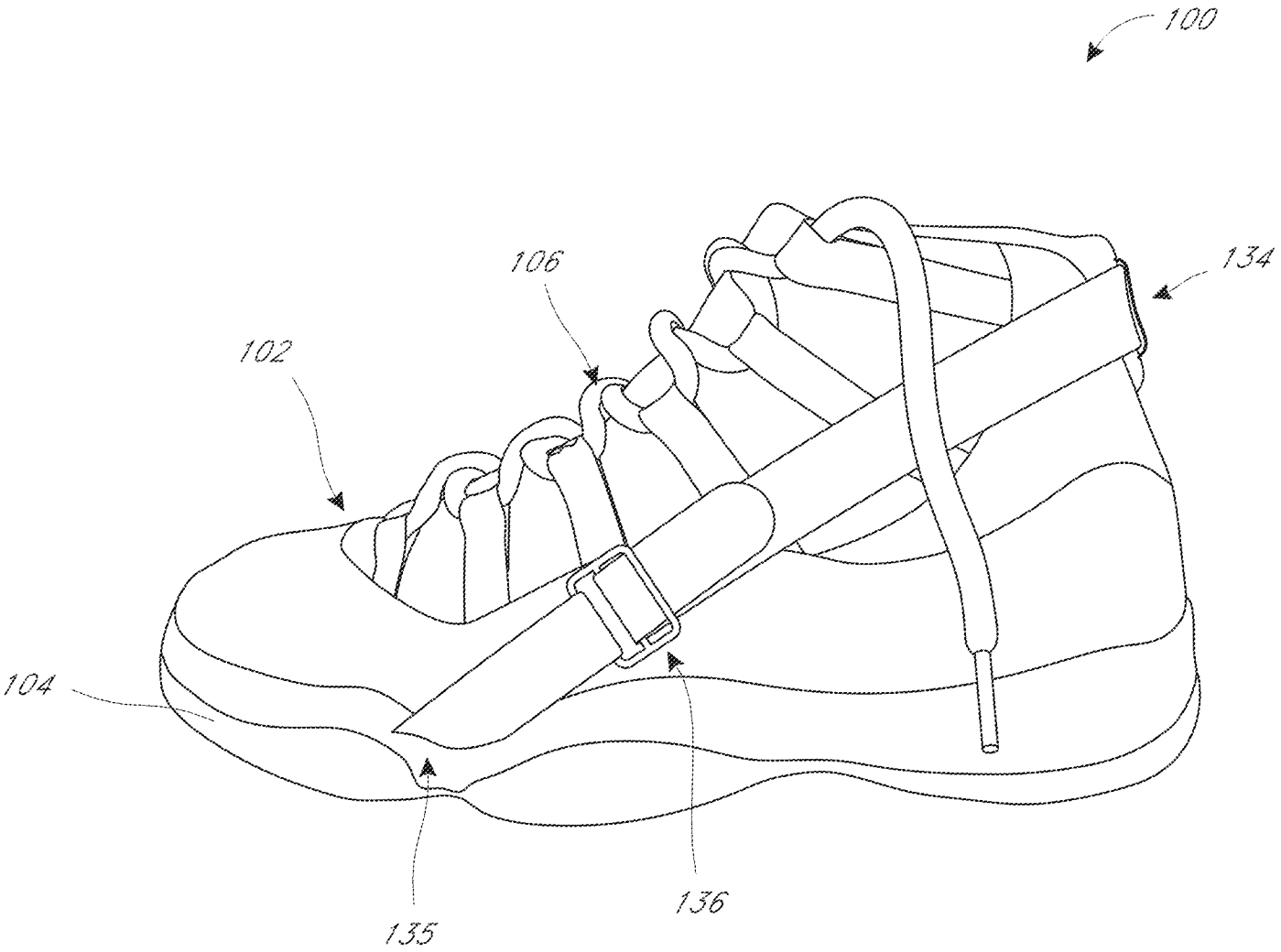
FIG. 10B is a schematic view of a lateral side of the left shoe in FIG. 10A, with the adjustable strap around the rear portion of the shoe that is adjustable by the user to adjust a tightness of the heel counter of the shoe about the user's heel.

FIGS. 10A and 10B show a medial side and a lateral side of the shoe 100 with an adjustment strap assembly 130 that wraps around the posterior end P of the shoe 100. The strap assembly 130 can be selectively adjusted by the user, as further described below. In one implementation, the strap assembly 130 includes a strap portion 131 that extends from an end 132 anchored or molded in the shoe 100 (e.g., in the sole 104 of the shoe 100). In an another implementation, the end 132 can instead be attached to or embedded in the upper 102. The strap portion 131 extends through a loop 133 at the upper posterior end 134 of the shoe 100 that generally aligns behind the foot's Achilles tendon when the shoe 100 is worn (e.g., strap portion 131 extends around the ankle of a foot). Though not shown, in other implementations the strap portion 131 can extend through multiple loops on the surface of the outer shell of the upper 102. The strap portion 131 extends at a posteriorly inclined angle between the end 132 and the loop 133. In another implementation, the strap portion 131 is fixed (e.g., sewn) to the upper posterior end 134 of the shoe 100, as further discussed below.

With reference to the implementation shown in FIG. 10B, the strap portion 131 wraps around the upper posterior end 134 of the shoe 100 and extends anteriorly along the lateral side of the shoe 100. An end of the strap portion 131 can extend through a hoop or buckle 136 and back onto itself, where it can couple to itself, for example with hoop-and-loop fasteners (e.g. VELCRO®). Other fastening mechanisms or systems are possible. In the illustrated implementation, the hoop or buckle 136 is attached to a strap portion 135 that has an end opposite the buckle 136 anchored or molded in the shoe 100 (e.g. in the sole 104 of the shoe 100). In another implementation, the end of the strap portion 135 opposite the buckle 136 can instead be attached to or embedded in the upper 102. In still another implementation, the strap portion 135 is excluded and the hoop or buckle 136 is attached to the lateral side of the outer shell of the upper 102. In still another implementation, the buckle 136 can be a ladder lock buckle. However, other fastening mechanisms or systems can be used in the strap assembly 130. In another implementation, the strap portion 131 is fixed (e.g., sewn) to the upper posterior end 134 of the shoe 100 and an adjustable medial strap portion and an adjustable lateral strap portion extend therefrom along medial and lateral sides of the outer shell of the upper 102, respectively. The medial and lateral strap portions can be adjusted independently of each other and fastened (e.g., with VELCRO®) to themselves or to the outer shell of the upper 102.

The user can adjust the strap portion 131 (e.g., by pulling on the medial and lateral strap portions) to adjust a distance between the upper posterior end 134 of the shoe and the posts 110 to allow the foot to move (e.g., a small amount, such as about 1/8 inch) anteriorly or posteriorly within the shoe 100 to improve (e.g., optimize) a location (e.g., provide a precise adjustment) of the posts 110 into the vertices of the toes of the foot, which can optimize comfort and/or performance of the shoe 100. For example, pulling (e.g., increasing tension) on the strap portion 131 (e.g., pulling on the medial and lateral strap portions) can shorten a distance between the upper posterior end 134 of the shoe 100 and the posts 110, allowing the foot to move anteriorly, and decreasing tension (e.g., giving slack) on the strap portion 131 (e.g., on the medial and lateral strap portions) can increase a distance between the upper posterior end 134 of the shoe 100 and the posts 110, allowing the foot to move posteriorly. An end of the strap portion 131 (e.g., ends of the medial and lateral strap portions) can be attached with fasteners (e.g., VELCRO®) to itself to retain the adjustment. Other fastening mechanisms or systems can be used.

Advantageously, adjusting the strap assembly 130 adjusts a distance between the upper posterior end 134 of the shoe and the posts 110 to optimize the position of the posts 110 within the vertices between the toes of the foot. Such an adjustment can provide the user with different levels of fit (e.g., a comfort fit, a performance fit) of the posts 110 within the vertices between the toes of the foot. Further, adjusting the strap assembly 130 can advantageously provide a snug fit for the shoe 100 over the foot (e.g., fit between the heel counter and the posts 110) without having to overly tighten laces or other fastening mechanism or system of the shoe, thereby resulting in improved blood circulation in the foot and a reduction in foot fatigue during motion. Such snug fit of the shoe 100 (e.g., between heel counter and posts 110) on the foot helps inhibit (e.g., prevent) shifting or sliding of the foot within the shoe 100 and therefore allow the user to initiate and terminate a motion (e.g. a medial motion, a lateral motion, a forward motion, a clockwise or counterclockwise pivoting motion) more quickly.

The shoe 100 advantageously provides an internal support (e.g., interstitial or between the toes support) for the user's foot with the posts 110 that provides improved support, stability and comfort to the user's foot. The posts 110 inhibit or limit motion of the foot within the shoe 100, such as when initiating or terminating a medial, lateral, or forward motion (e.g., running, hiking or walking on a level surface or downhill) or when initiating or terminating a clockwise or counterclockwise pivoting motion about the toe portion of the shoe.

The shoe 100 can improve the performance of the user, such as in moving medially or laterally, or pivoting about the toe portion of the shoe 100. For example, when the shoe 100 is an athletic shoe, such as a basketball shoe or tennis shoe, the internal support in the shoe 100 provided by the posts 110 allow the wearer to react or change direction more quickly. This is because, unlike in conventional shoes, the user's foot does not need to reach the medial or lateral sidewall of the shoe when moving medially or laterally before the user can move in the opposite direction. Since the posts 110 in the shoe 100 apply a force that counters medial or lateral motion by the user's foot, the user is more quickly able to transition to motion in an opposite direction (e.g., transition to a medial direction if initially moving laterally, or vice versa), which can allow the user to react and/or move more quickly (e.g., shifting direction while playing basketball, playing tennis, etc.). Accordingly, the internal support of the shoe 100 provided by the posts 110 allow a user to brake or terminate a motion more quickly when moving medially or laterally due to the distribution of load or force through the upper 102, sole 104 and/or insole 105. Therefore, the amount of time needed to brake or terminate a motion when moving medially or laterally in the shoe 100, as well as the time needed to change direction, is advantageously diminished, allowing the wearer to react more quickly (e.g., several milliseconds faster). Such quicker reaction time provided by the shoe 100 can enhance the ability of the user to move faster and change direction more quickly when playing a game where moving medially and/or laterally is common (e.g., basketball, tennis).

Similarly, when pivoting about the front end of the shoe 100 (e.g., pivoting clockwise or counter-clockwise), unlike in conventional shoes, the user's foot does not need to rotate within the shoe and reach the medial or lateral sidewall of the shoe when rotating medially or laterally, respectively, before the user can stop or move, such as in a different direction. Since the posts 110 in the shoe 100 engage the toes (via the vertices between the toes) to apply a force that counters medial or lateral rotation motion by the user's foot within the shoe 100, the user is more quickly able to stop and/or transition to a different motion (e.g., in an opposite direction, which can allow the user to pivot or react more quickly (e.g., pivoting while playing basketball, playing tennis, etc.). That is, the engagement time between the foot and shoe 100 when pivoting are diminished with less rotation time of the forefoot needed to encounter the controlling surfaces of the shoe 100 (e.g., six controlling surfaces in the shoe 100 provided by the four posts 110 and the medial and lateral interior walls of the outer shell of the upper 102). Accordingly, the internal toe-reliant support of the shoe 100 provided by the posts 110 allow a user to initiate and terminate a pivoting motion more quickly due to the distribution of load or force through the upper 102, sole 104 and/or insole 105. Therefore, the amount of time needed to pivot when rotating medially or laterally about the front end of the shoe 100, as well as the start and stop time for pivoting about the front end of the shoe 100, is advantageously diminished, allowing the wearer not to shift as much inside their shoe but to react more quickly when pivoting (e.g., a few milliseconds faster). Such quicker reaction time provided by the shoe 100 can enhance the ability of the user to pivot faster and change direction more quickly when playing a game or competing in a sport where pivoting quickly is common (e.g., basketball, tennis).

Figure 11:
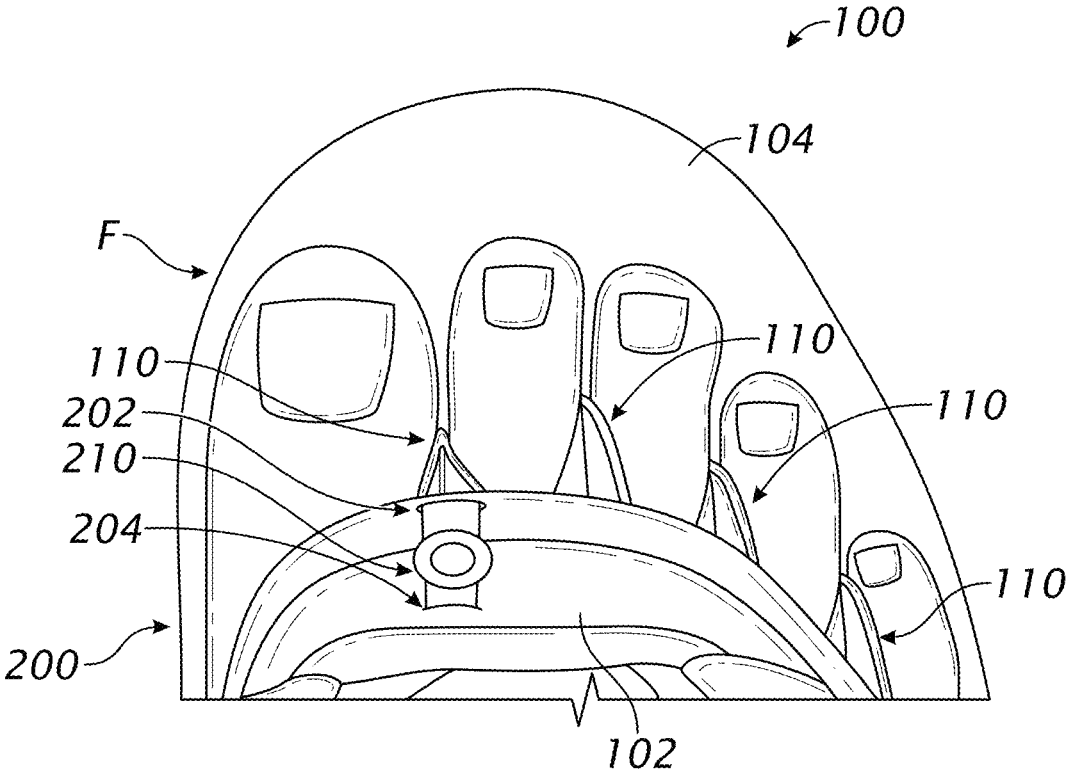
FIG. 11 is a schematic partial top view of the right shoe of FIG. 3, with the front section of the upper removed to illustrate the interstitial toe reliant support structure inside the shoe and a mechanism for adjusting a length of the interstitial toe reliant support structure, and a human foot inside the shoe in a neutral position.

FIG. 11 shows a partial top view of the right shoe 100, with the front section of the upper removed to illustrate the toe posts 110 inside the shoe and a human foot inside the shoe in a neutral position, where the toe posts 110 can extend between adjacent toes. In the illustrated implementation, the shoe 100 can have a post length adjustment mechanism 200 for adjusting a length of the post 110 that extends between the upper 102 and the sole 104 between a pair of toes. Though FIG. 11 shows a post length adjustment mechanism 200 for adjusting a length of the post 110 between the big toe and the second toe adjacent the big toe, one of skill in the art will recognize that the post length adjustment mechanism 200 can be provided for all of the toe posts 110 of the shoe 100, or less than all of the toe posts 110 of the shoe 100 (e.g., only the toe post 110 between the big toe and the adjacent toe).

In one implementation, the post length adjustment mechanism 200 can include a lock 210 (e.g., manually actuatable lock) through which at least a portion of the toe post 110 extends. In one example, the toe post 110 can extend through a slot 202 in the upper 102 and have an end 204 anchored to the upper 102. The lock 210 can be actuated (e.g., manually actuated by a user) to adjust a length of the toe post 110 between the sole 104 and the upper 102 (e.g., by adjusting a length of the toe post 110 between the lock and the anchored end 204. In one example, the lock 210 can be spring loaded, such as a spring clasp (or cord lock) having one portion that can moved relative to another portion to allow the toe post 110 to be pulled through an opening of the lock 210 (e.g., to adjust the length of the toe post 110). The lock 210 can be biased (by a spring) toward a locked position where the opening of the lock 210 is reduced or closed to lock a position or length of the toe post 110. The post length adjustment mechanism 200 advantageously allows the length of the toe post(s) 110 between the upper 102 and sole 104 to be adjusted to adjust the function of the toe posts 110 (e.g., allow the toes to move more or less, such as laterally or medially, relative to the toe posts 110).

ADDITIONAL EMBODIMENTS

In embodiments of the present invention, a shoe may be in accordance with any of the following clauses:

Clause 1: A shoe, comprising:

a sole;

an upper attached to the sole about a circumference of the sole, the upper and sole defining an interior space configured to receive a human foot therein; and two to four posts of flexible non-stretchable material disposed in a forefoot portion of the interior space, the posts extending between and attached to the upper and the sole, the posts spaced apart from a front end of the shoe, each of the posts configured to extend into a gap between adjacent toes in the foot and be positioned proximate a vertex of the gap between the adjacent toes, one or more of the posts configured to be disposed on a medial side of a center or third toe of the foot and one or more of the posts configured to be disposed on a lateral side of the center or third toe of the foot when the foot is inside the shoe, the posts configured to distribute a load exerted by the foot to the upper and sole during motion of the foot.

Clause 2: The shoe of clause 1, wherein the posts inhibit motion of the foot within the shoe in one or more of a medial direction, a lateral direction, an anterior direction, a clockwise rotational direction, and a counterclockwise rotational direction.

Clause 3: The shoe of any preceding clause, wherein the two to four posts are two posts, a first post configured to extend between a big toe and a second toe of the foot, and a second post configured to extend between a third toe and a fourth toe of the foot.

Clause 4: The shoe of any preceding clause, wherein the two to four posts are two posts, a first post configured to extend between a big toe and a second toe of the foot, and a second post configured to extend between a third toe and a fifth toe of the foot.

Clause 5: The shoe of any preceding clause, wherein the two to four posts are three posts, a first post configured to extend between a big toe and a second toe of the foot, a second post configured to extend between the second toe and a third toe of the foot, and a third post configured to extend between the third toe and a fourth toe of the foot.

Clause 6: The shoe any preceding clause, wherein the two to four posts are three posts, a first post configured to extend between a big toe and a second toe of the foot, a second post configured to extend between the second toe and a third toe of the foot, and a third post configured to extend between a fourth toe and a fifth toe of the foot.

Clause 7: The shoe of any preceding clause, wherein the two to four posts are three posts, a first post configured to extend between a big toe and a second toe of the foot, a second post configured to extend between a third toe and a fourth toe of the foot, and a third post configured to extend between the fourth toe and a fifth toe of the foot.

Clause 8: The shoe of any preceding clause, wherein the two to four posts are four posts, a first post configured to extend between a big toe and a second toe of the foot, a second post configured to extend between the second toe and a third toe of the foot, a third post configured to extend between the third toe and a fourth toe of the foot, and a fourth post configured to extend between the fourth toe and a fifth toe of the foot.

Clause 9: The shoe of clause 8, wherein an end of the first post is disposed anteriorly of an end of the second post, the end of the second post is disposed anteriorly of an end of the third post, the end of the third post is disposed anteriorly of an end of the fourth post Clause 10: The shoe of any preceding clause, further comprising an actuatable lock for adjusting a length of the posts between the upper and the sole.

Clause 11: A shoe, comprising:

a sole;

an upper attached to the sole about a circumference of the sole, the upper and sole defining an interior space configured to receive a human foot therein;

two to four posts of flexible non-stretchable material disposed in a forefoot portion of the interior space, the posts extending between and attached to the upper and the sole, the posts spaced apart from a front end of the shoe, each of the posts configured to extend into a gap between adjacent toes in the foot and be positioned proximate a vertex of the gap between the adjacent toes, one or more of the posts configured to be disposed on a medial side of a center or third toe of the foot and one or more of the posts configured to be disposed on a lateral side of the center or third toe of the foot when the foot is inside the shoe; and an adjustable strap extending around an upper portion of a heel counter of the shoe configured to be disposed behind an Achilles tendon of a foot, the strap extending anteriorly from said upper portion of the heel counter along a medial side and a lateral side of the outer shell of the upper, wherein the posts configured to distribute a load exerted by the foot to the upper and sole during motion of the foot, and wherein the strap is adjustable to adjust a distance between the upper portion of the heel counter and the posts to thereby allow the foot to move anteriorly or posteriorly to optimize a position of the posts in the vertices between the toes of the foot.

Clause 12: The shoe of clause 10, wherein the loop or buckle is attached to the lateral side of the outer shell of the upper.

Clause 13: The shoe of any of clauses 10-12, wherein the loop or buckle is attached to a second strap that extends to an end attached to or embedded in a lateral side of the sole.

Clause 14: The shoe of any of clauses 10-13, wherein the posts inhibit motion of the foot within the shoe in one or more of a medial direction, a lateral direction, an anterior direction, a clockwise rotational direction, and a counterclockwise rotational direction.

Clause 15: The shoe of any of clauses 10-14, wherein the two to four posts are two posts, a first post configured to extend between a big toe and a second toe of the foot, and a second post configured to extend between a third toe and a fourth toe of the foot.

Clause 16: The shoe of any of clauses 10-15, wherein the two to four posts are two posts, a first post configured to extend between a big toe and a second toe of the foot, and a second post configured to extend between a third toe and a fifth toe of the foot.

Clause 17: The shoe of any of clauses 10-16, wherein the two to four posts are three posts, a first post configured to extend between a big toe and a second toe of the foot, a second post configured to extend between the second toe and a third toe of the foot, and a third post configured to extend between the third toe and a fourth toe of the foot.

Clause 18: The shoe of any of clauses 10-17, wherein the two to four posts are three posts, a first post configured to extend between a big toe and a second toe of the foot, a second post configured to extend between the second toe and a third toe of the foot, and a third post configured to extend between a fourth toe and a fifth toe of the foot.

Clause 19: The shoe of any of clauses 10-18, wherein the two to four posts are three posts, a first post configured to extend between a big toe and a second toe of the foot, a second post configured to extend between a third toe and a fourth toe of the foot, and a third post configured to extend between the fourth toe and a fifth toe of the foot.

Clause 20: The shoe of any of clauses 10-19, wherein the two to four posts are four posts, a first post configured to extend between a big toe and a second toe of the foot, a second post configured to extend between the second toe and a third toe of the foot, a third post configured to extend between the third toe and a fourth toe of the foot, and a fourth post configured to extend between the fourth toe and a fifth toe of the foot.

Clause 21: The shoe of clause 20, wherein an end of the first post is disposed anteriorly of an end of the second post, the end of the second post is disposed anteriorly of an end of the third post, the end of the third post is disposed anteriorly of an end of the fourth post.

While certain embodiments of the inventions have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. The accompanying claims and their equivalents are intended to cover such forms or modifications as would fall within the scope and spirit of the disclosure. Accordingly, the scope of the present inventions is defined only by reference to the appended claims.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

Of course, the foregoing description is that of certain features, aspects and advantages of the present invention, to which various changes and modifications can be made without departing from the spirit and scope of the present invention. Moreover, the devices described herein need not feature all of the objects, advantages, features and aspects discussed above. Thus, for example, those of skill in the art will recognize that the invention can be embodied or carried out in a manner that achieves or optimizes one advantage or a group of advantages as taught herein without necessarily achieving other objects or advantages as may be taught or suggested herein. In addition, while a number of variations of the invention have been shown and described in detail, other modifications and methods of use, which are within the scope of this invention, will be readily apparent to those of skill in the art based upon this disclosure. It is contemplated that various combinations or subcombinations of these specific features and aspects of embodiments may be made and still fall within the scope of the invention. Accordingly, it should be understood that various features and aspects of the disclosed embodiments can be combined with or substituted for one another in order to form varying modes of the discussed devices.

What is claimed is:

1. An athletic shoe, comprising:

a sole;

an upper attached to the sole about a circumference of the sole, the upper and sole defining an interior space configured to receive and enclose a human foot therein;

two to four posts of flexible non-stretchable material disposed in a forefoot portion of the interior space, the flexible non-stretchable material configured to stretch less than 5% of its original length, the posts extending between and attached to the upper and the sole, the posts spaced apart from a front end of the shoe, each of the posts configured to extend into a gap between adjacent toes in the foot and be positioned at proximate a vertex of the gap between the adjacent toes, each post having one or more leverage control surfaces that engage the vertex between said adjacent toes to allow a user to initiate and terminate a sideways or forward motion or initiate and terminate a pivoting action more quickly, one or more of the posts configured to be disposed on a medial side of a center or third toe of the foot and/or one or more of the posts configured to be disposed on a lateral side of the center or third toe of the foot when the foot is inside the shoe; and an adjustable strap having a first strap portion extending around an upper portion of a heel counter of the shoe configured to be disposed behind an Achilles tendon of the foot, the first strap portion extending anteriorly from said upper portion of the heel counter along a medial side and a lateral side of the upper, one end of the first strap portion extending to and fixedly and directly anchored in the medial side and the lateral side of the sole, a loop or buckle attached to an end of a second strap portion that extends to an end of the second strap portion extending to and fixedly and directly anchored in the lateral side of the sole, the loop or buckle receiving an end of the first strap portion to fasten the first strap portion to the second strap portion of the strap;

wherein the posts are configured to distribute a load exerted by the foot to the upper and sole during motion of the foot, and wherein the strap is adjustable to adjust a distance between the upper portion of the heel counter and the posts to thereby move the foot anteriorly so that each post is positioned at the vertex between adjacent toes, the leverage control surfaces of each post engaging the vertex to thereby bear on the foot to allow the user to initiate and terminate a sideways or forward motion or change direction of motion more quickly while preventing shifting or sliding of the foot inside the upper, thereby optimizing athletic performance and comfort during use of the shoe.

2. The shoe of claim 1, wherein the posts inhibit motion of the foot within the shoe in one or more of a medial direction, a lateral direction, an anterior direction, a clockwise rotational direction, and a counterclockwise rotational direction.

3. The shoe of claim 1, wherein the two to four posts are two posts, a first post configured to extend between a big toe and a second toe of the foot, and a second post configured to extend between the third toe and a fourth toe of the foot.

4. The shoe of claim 1, wherein the two to four posts are two posts, a first post configured to extend between a big toe and a second toe of the foot, and a second post configured to extend between the third toe and a fifth toe of the foot.

5. The shoe of claim 1, wherein the two to four posts are three posts, a first post configured to extend between a big toe and a second toe of the foot, a second post configured to extend between the second toe and the third toe of the foot, and a third post configured to extend between the third toe and a fourth toe of the foot.

6. The shoe of claim 1, wherein the two to four posts are three posts, a first post configured to extend between a big toe and a second toe of the foot, a second post configured to extend between the second toe and the third toe of the foot, and a third post configured to extend between a fourth toe and a fifth toe of the foot.

7. The shoe of claim 1, wherein the two to four posts are three posts, a first post configured to extend between a big toe and a second toe of the foot, a second post configured to extend between the third toe and a fourth toe of the foot, and a third post configured to extend between the fourth toe and a fifth toe of the foot.

8. The shoe of claim 1, wherein the two to four posts are four posts, a first post configured to extend between a big toe and a second toe of the foot, a second post configured to extend between the second toe and the third toe of the foot, a third post configured to extend between the third toe and a fourth toe of the foot, and a fourth post configured to extend between the fourth toe and a fifth toe of the foot.

9. The shoe of claim 8, wherein an end of the first post is disposed anteriorly of an end of the second post, the end of the second post is disposed anteriorly of an end of the third post, the end of the third post is disposed anteriorly of an end of the fourth post.

* * * * *